US009168931B1

(12) United States Patent
Olson et al.

(10) Patent No.: US 9,168,931 B1
(45) Date of Patent: Oct. 27, 2015

(54) SUSPENDED RECREATIONAL VEHICLE

(75) Inventors: Scott Olson, Waconia, MN (US); Sean Horihan, Brooklyn Park, MN (US)

(73) Assignee: Skyride Technology, Inc., Waconia, MN (US)

( * ) Notice: Subject to any disclaimer, the term of this patent is extended or adjusted under 35 U.S.C. 154(b) by 143 days.

(21) Appl. No.: 13/277,649

(22) Filed: Oct. 20, 2011

Related U.S. Application Data

(63) Continuation-in-part of application No. 11/462,162, filed on Aug. 3, 2006, now Pat. No. 8,156,873.

(51) Int. Cl.
*B61B 10/02* (2006.01)

(52) U.S. Cl.
CPC ..... *B61B 10/025* (2013.01)

(58) Field of Classification Search
CPC ..... B61B 7/00; B61B 7/06; B61B 9/00; B61B 10/00; B61B 10/02; B61B 11/00
USPC ..... 104/53, 89, 91, 106, 118, 162, 165
See application file for complete search history.

(56) References Cited

U.S. PATENT DOCUMENTS

| | | | | |
|---|---|---|---|---|
| 639,778 | A | | 12/1899 | Shakespear |
| 3,192,872 | A | * | 7/1965 | Parent ..... 104/93 |
| 3,568,605 | A | | 3/1971 | Pettit |
| 4,445,502 | A | | 5/1984 | Swan et al. |
| 4,548,136 | A | | 10/1985 | Yamada |
| 4,911,426 | A | | 3/1990 | Scales |
| 4,928,601 | A | | 5/1990 | Harder et al. |
| 5,458,550 | A | | 10/1995 | Braim et al. |
| 5,461,984 | A | | 10/1995 | Amdress, III |
| 5,468,199 | A | | 11/1995 | Keeler et al. |
| 5,592,883 | A | | 1/1997 | Andress, III |
| 5,709,154 | A | | 1/1998 | Schott |
| 6,062,173 | A | | 5/2000 | Heinrichs |
| 6,105,507 | A | | 8/2000 | Jelf et al. |
| 6,315,138 | B1 | | 11/2001 | Dyson |

* cited by examiner

*Primary Examiner* — R. J. McCarry, Jr.
(74) *Attorney, Agent, or Firm* — Haugen Law Firm PLLP

(57) ABSTRACT

A recreational apparatus is provided having an elevated railway system with a vehicle suspended therefrom. The vehicle includes a drive mechanism that is responsive to energy input in order to advance the vehicle along the elevated railway system. The drive mechanism is capable of efficiently motivating the vehicle along straight and curved sections of the elevated railway system with minimal stress on moving parts, and minimal frictional losses.

19 Claims, 19 Drawing Sheets

10
16
14
44
12
42
40
20
22
38
28
24
30
26
34
18
36
32

510

532
534
530
546
514
576
564
574
590
590
572
566
512
522
520
540
521
551
550
568
582
570
538
501
518

SUSPENDED RECREATIONAL VEHICLE

CROSS-REFERENCE TO RELATED APPLICATIONS

This is a continuation-in-part of U.S. patent application Ser. No. 11/462,162, filed on Aug. 3, 2006 now U.S. Pat. No. 8,156,873 and entitled "Rail Bike", the content of which being incorporated herein in its entirety.

FIELD OF THE INVENTION

The present invention relates generally to the field of exercise and recreational devices. More particularly, the present invention relates to a vehicle suspended from an elevated rail system for use as a recreational or exercise device.

BACKGROUND OF THE PRIOR ART

The prior art provides a number of stationary cardiovascular exercise machines. Such machines include treadmills, stationary bicycles, elliptical machines, rowing machines and the like. These devices are commonly found at health clubs and in private residences.

A problem with such prior art machines is that they can become monotonous to use. The user is stuck in a single position for the entire duration of an exercise session.

U.S. Pat. No. 4,928,601 attempts to address this problem by providing a monorail system having a track on a top side thereof for receiving and guiding the tires of a traditional bicycle on a top side of the monorail system track. A user may then ride the bicycle around on the monorail track. A problem with this prior art system is that the bicycles must be fitted with a special apparatus in order to avoid physical contact with other bicycles. Additionally, bicycles must ride in-line with each other, preventing one user from passing another or achieving a speed faster than a bicycle positioned in front of the user.

A further problem with the above system is that it is limited to the use of bicycles at the exclusion of other types of cardiovascular exercise machines.

In addition to exercise devices, recreational vehicles, such as amusement rides generally do not permit interactive engagement with the vehicle to independently control velocity and direction along selected pathways of a plurality of interconnecting rails.

It would, therefore, be advantageous to provide a system that overcomes these and additional shortcomings of the prior art.

SUMMARY OF THE INVENTION

The present invention provides a recreational apparatus that includes an elevated railway system and a vehicle suspended therefrom.

The vehicle includes a frame and drive mechanism such as a pedal assembly such that, for example, a rider may comfortably ride in the vehicle and actuate the drive mechanism, such as with his or her legs in the case of a pedal assembly. The drive mechanism may be coupled, such as via a chain or belt, to a wheel assembly or other such motive assembly, which causes the vehicle to advance along the elevated railway system when the drive mechanism is actuated.

The frame is suspended from the elevated rail system by a coupling assembly. The coupling assembly may incorporate one or more sets of rollers for movably contacting the frame to the rail.

The coupling assembly is connected to the frame of the vehicle such that the motive assembly or wheel assembly provides the driving force for advancing the coupling assembly along an elongate pathway defined by the rail.

The elevated rail system may incorporate a plurality of interlinked pathways wherein one or many vehicles may advance along any number of such pathways. For example, the rail system may include any number of diverters having a single pathway that leads to multiple pathways, wherein any of such pathways may be selectively taken by a carrier.

The carrier may further include any number of performance features including but not limited to a hand brake for slowing the drive wheel assembly, a hand throttle for adjusting the frictional force between the drive wheel and rail, and an adjustable guide for preselecting one of a plurality of paths along the rail system.

A variety of different vehicle arrangements and configurations may be utilized in accordance with the present invention, and may include one or more of a variety of drive mechanisms, including but not limited to manual drive mechanisms such as orbiting pedals, reciprocating pedals, a rowing mechanism, and a treadmill mechanism, as well as motor-driven drive mechanisms.

The recreational apparatus of the present invention may include an elevated railway system defining a first track, and a vehicle motivatable along the track with a drive mechanism. The drive mechanism of the vehicle includes an input device for receiving energy and translating the energy into a mechanical motion useful in motivating the vehicle along the track, wherein the mechanical motion is delivered to a drive sprocket. The drive mechanism further includes a first drive wheel driven by the drive sprocket, wherein the first drive wheel supports a drive element, and transmits the mechanical motion to the drive element along a first radial plane of the first drive wheel. A second drive wheel apparatus of the drive mechanism includes a circumferential drive surface in contact with the track. The second drive wheel apparatus includes a drive member that is rotatably driven about a drive axis by the drive element to convey motion to the vehicle along the track. The drive member defines a second radial plane.

A first alignment wheel of the drive mechanism defines a first alignment radial plane in which the drive element is supported about a portion of a circumference of the first alignment wheel. In preferred arrangements, the first alignment wheel may be pivotable about a first pivot axis to adjust the first alignment radial plane between substantial co-extension with both of the first and second radial planes, and skewed with respect to the second radial plane. A second alignment wheel defines a second alignment radial plane in which the drive element is supported about a portion of a circumference of the second alignment wheel. The second alignment wheel may be pivotable about a second pivot axis to adjust the second adjustment radial plane between substantial co-extension with both of the first and second radial planes, and skewed with respect to the second radial plane.

In another embodiment, the recreational apparatus of the present invention includes an elevated railway system defining a plurality of tracks, with a first carrier rail having a first interior channel defining a first track, and a second carrier rail having a second interior channel defining a second track. The railway system includes a merging portion and a diverging portion connecting the first carrier rail to the second carrier rail. The merging portion includes a first door selectively actuatable between open and closed positions for selectively and reversibly establishing a merge condition of the second track to the first track. The diverging portion includes a second door selectively actuatable between open and closed positions for selectively and reversibly establishing a diverging condition of the second track from the first track. Each of the first and second doors include a first track portion and a second track portion, with the first track portion of the first and second doors selectively completing the first track at the merging and diverging portions. The second track portion of the first and second doors selectively complete the second track at the merging and diverging portions of the railway system.

The recreational apparatus further includes a vehicle motivatable along the first and second tracks, wherein the vehicle is suspended from a respective first or second track by a drive mechanism, including a drive wheel rotatable coupled to a respective first or second track within a respective first or second interior channel.

DETAILED DESCRIPTION OF THE PREFERRED EMBODIMENTS

Figure 1:
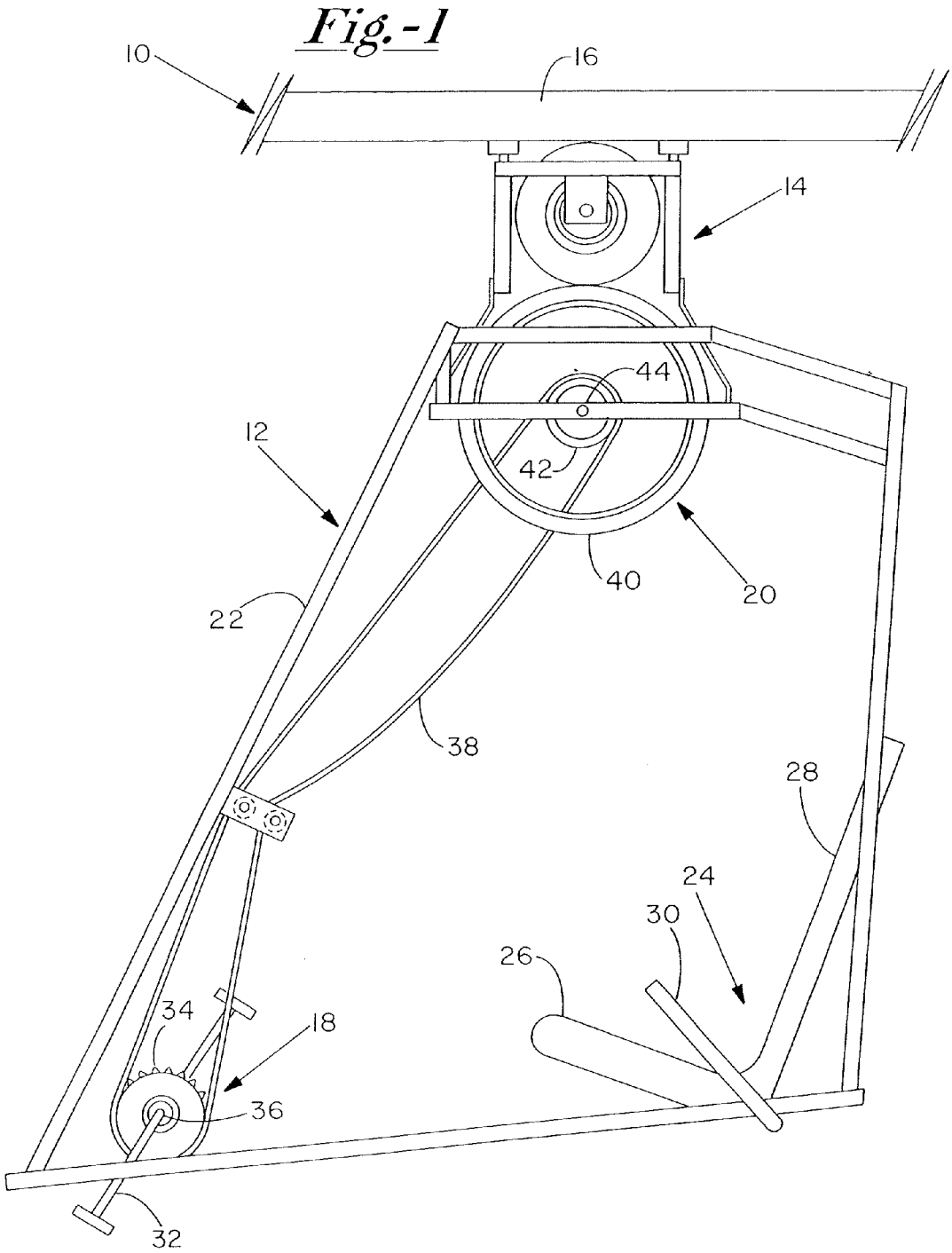
FIG. 1 illustrates a side view of an elevated railway system and vehicle suspended therefrom.

FIG. 1 illustrates an elevated railway system 10 defining an elongate pathway about which a vehicle 12 is able to travel. The vehicle 12 is suspended from the elevated rail system 10 by a coupling assembly/drive mechanism 14 configured to movably engage the rail 16 of the elevated railway system 10. The vehicle 12 may be advanced along the rail 16 by actuating an input device, such as pedal assembly 18, that is operably coupled to a drive wheel assembly 20.

In one embodiment, the vehicle 12 includes a frame 22 for supporting a seat assembly 24 and pedal assembly 18 such that the pedal assembly 18 is accessible therefrom. As shown, the seat assembly 24 includes a seat portion 26, a back support 28 and one or more handles 30 on opposing sides of the seat assembly 24.

The pedal assembly 18 of such embodiment includes a crank 32 and gear system 34, as is common in the art and is rotatable about an axis 36 supported by a lower portion of the frame 22. A chain 38 couples the pedal assembly 18 to the wheel assembly 20.

The wheel assembly 20 of the illustrated embodiment includes a wheel 40 rotatable by a gear system 42 when the pedal assembly 18 is actuated. It is contemplated that the gear system 42 may include shiftable gears such that the chain 38 may be selectively positioned on any one of a plurality of parallel gears with distinct size ratios in comparison to gear system 34.

An upper section of the frame 22 provides an axis 44 for the wheel assembly 20 and further provides one or more connecting members 46, 47 for selectively securing the frame 22 of the carrier 12 to the coupling assembly/drive mechanism 14.

Figure 2A:
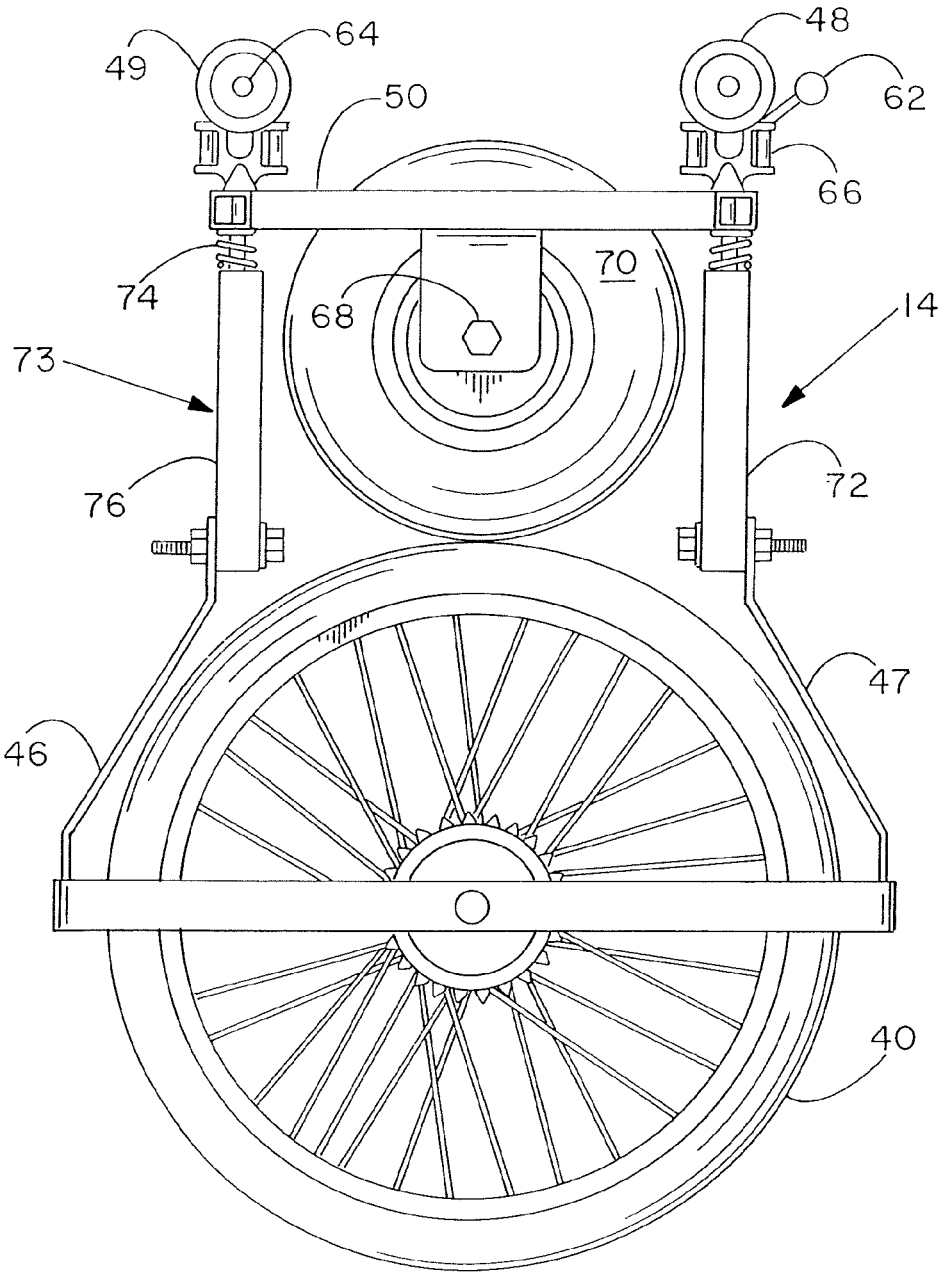
FIG. 2A illustrates a side view of a coupling assembly.
Figure 2B:
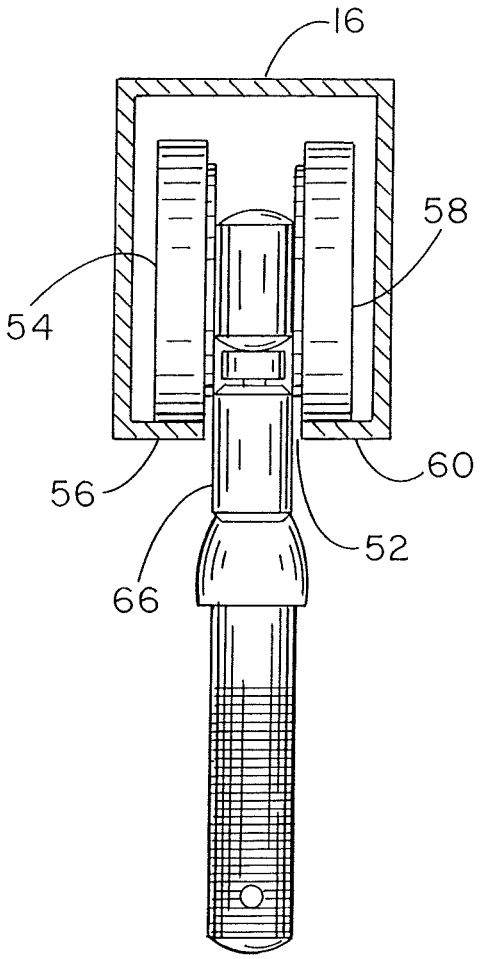
FIG. 2B illustrates a front view of the coupling assembly from FIG. 2A.

FIGS. 2A and 2B illustrate a more detailed view of the coupling assembly/drive mechanism 14 of the illustrated embodiment. A first and second set of rollers 48, 49 are spaced from each other about a coupling frame 50. The rollers 48, 49 are configured to be received within a channel 52 of the elevated railway system 10 such that the coupling frame 50 is suspended therefrom. The rollers 48, 49 thus are movably received within the channel 52 of the elevated rail system 10. In the illustrated embodiment, each set of rollers 48, 49 includes a first roller 54 received on a first lip 56 of the channel 52 and a second roller 58 received on a second lip 60 of the channel 52 and to rotate about an axis 64 such that outer circumferences of the rollers 54, 58 contact the lip 56, 60 of the channel 52 respectively to drive vehicle 14 along elevated railway system 10.

A limit roller 62 or fin extends from a portion of coupling frame 50 such that the limit roller 62 extends within the channel 52 of the rail 16. The limit roller 62 prevents the coupling assembly/drive mechanism 14 from overly swinging from side to side with respect to the elongate pathway defined by the rail 16. It is further contemplated that the elongate railway system 10 may include a plurality of intersecting pathways. In such case, the fin 62 may be selectively positioned to guide the coupling assembly/drive mechanism 14 into a predetermined one of said plurality of pathways.

Coupling frame 50 may include one or more guide rollers 66 that extend about a generally vertical axis into the channel 52 to properly align rollers 48, 49 within channel 52. The guide rollers 66 preferably maintain the centrality of rollers 48, 49 within channel 52 by limiting movement of rollers 48, 49 toward respective side walls 57*a*, 57*b* of rail 16. The coupling frame 50 of the present embodiment further provides a fixed axis 68 for a translation wheel 70. The translation wheel 70 rotates about the axis 68 so as to simultaneously contact the bottom surface of the rail 16 and the top surface of the drive wheel 40 of the carrier 12. In operation, the rotation of the drive wheel 40 causes the translation wheel 70 to rotate in the opposite direction and thus drive the vehicle 12 along the elongate pathway in accordance with the rotation of the translation wheel 70.

It is contemplated that the chain 38 extending between the pedal assembly 18 and drive wheel assembly 20 may be configured such that the translation wheel 70 may be eliminated and the drive wheel 40 makes direct contact with the rail 16 wherein a forward pedal motion will result in a forward motion of the vehicle 12 along the rail 16.

Returning now to the illustrated embodiment, the connecting members 46, 47 of the vehicle are each connected to the coupling frame 50 via a corresponding tension member 72, 73. The tension member 72, 73 of the present embodiment incorporates a threaded inner sleeve 74 and corresponding outer connecting sleeve 76. The outer sleeve 76 may be adjusted with respect to the inner sleeve 74 to selectively increase or decrease the frictional contact between the drive wheel 40 and the translation wheel 70.

It is contemplated that the tension member 72, 73 could alternatively be used to selectively increase or decrease direct functional contact between the drive wheel assembly 20 and the rail 16 in an embodiment of the present invention wherein the translation wheel 70 has been eliminated.

In this or other embodiments described herein, it is contemplated that a number of controls and coupling systems may be accessible and/or operable from the handle 30 of the seat assembly 24. For example, a hand brake may be coupled to brake pads positioned about the drive wheel 40; a guide may be coupled to the fin 62 for selectively choosing a pathway; a throttle may be coupled to the tension member(s) 72, 73 to selectively adjust the tension between the drive wheel 40 and the rail 16; and additional such controls and coupling systems may be incorporated and operably accessible from the seat assembly 24.

Figure 3:
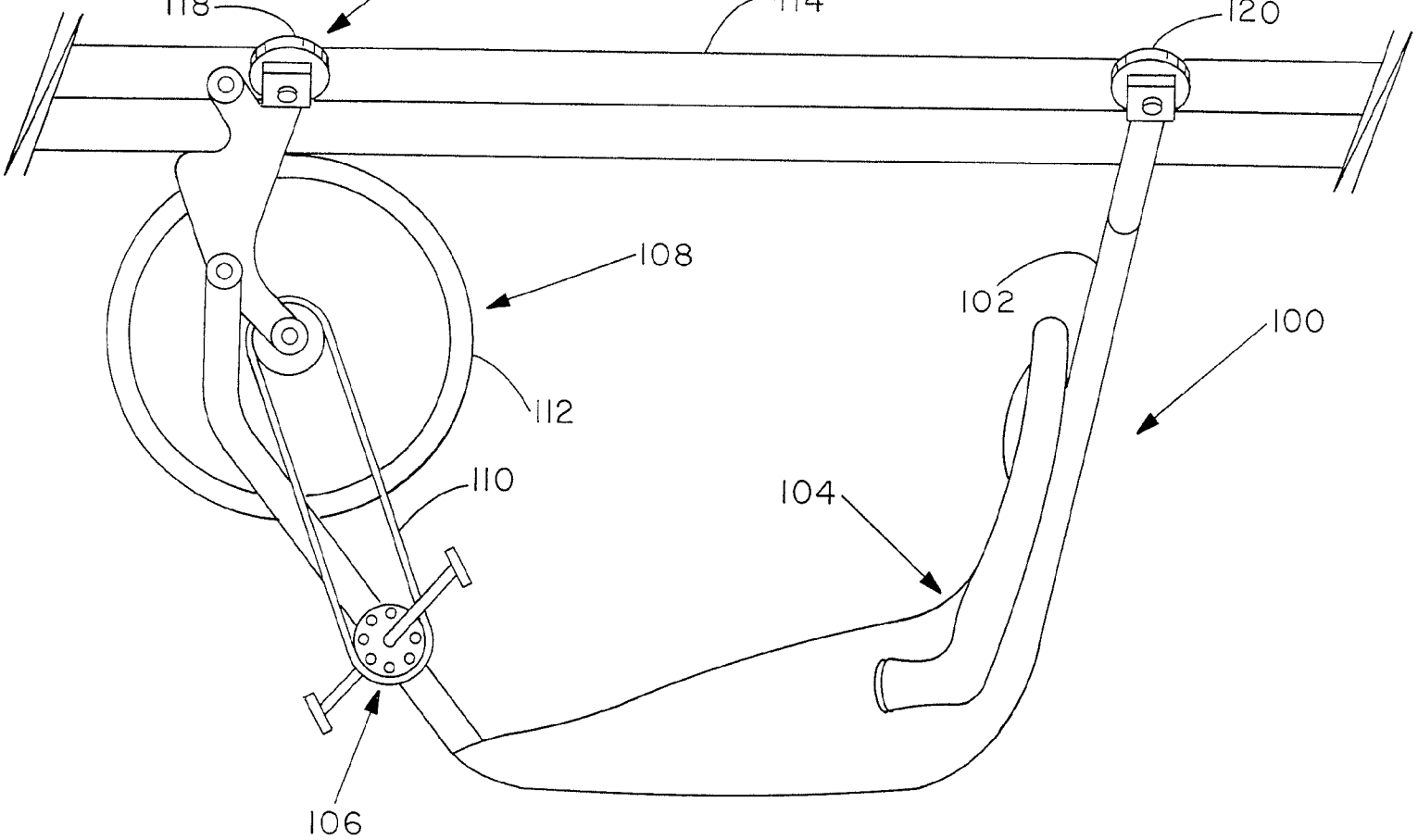
FIG. 3 illustrates a side view of an elevated railway system and carrier suspended therefrom.

FIG. 3 shows an alternative embodiment of the present invention wherein the vehicle 100 includes a frame 102 having a seat assembly 104 at a rear portion thereof and a pedal assembly 106 at a front portion thereof. The pedal assembly 106 is coupled to a drive wheel assembly 108 by a chain 110 such that the drive wheel 112 rotates when the pedal assembly 106 is actuated. The drive wheel 112 is in direct contact with a bottom surface of the elevated rail 114 to advance the vehicle 100 along the rail 114.

In this embodiment, the coupling assembly 116 includes a front set of rollers 118 that are configured to contact an upper surface of the rail 114 to support the front section of the frame 102, suspended therefrom. A rear set of rollers 120 are configured to contact an upper surface of the rail 114 and support the rear section of the frame 102.

Figure 4:
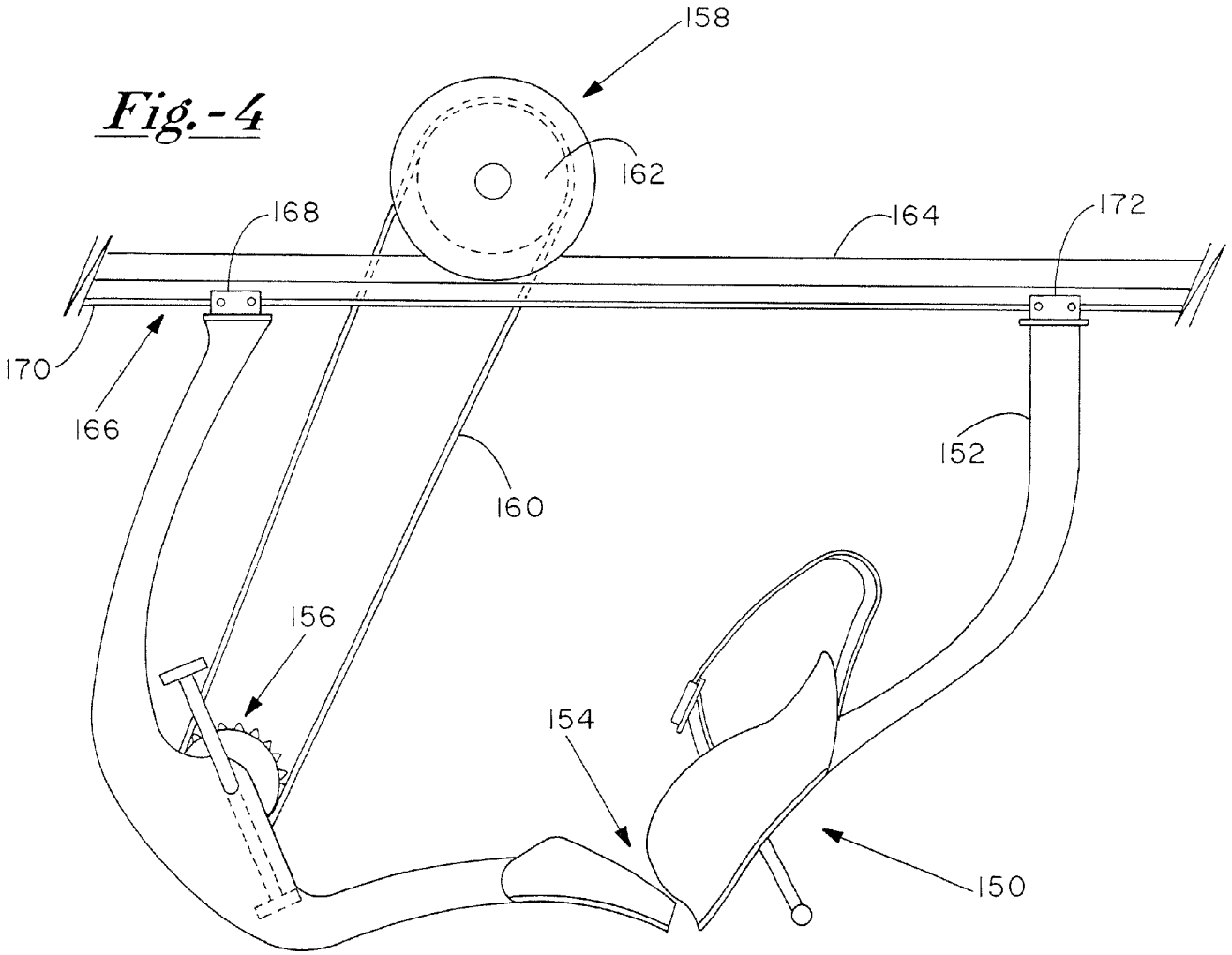
FIG. 4 illustrates an elevated railway system and vehicle suspended therefrom.

FIG. 4 illustrates yet another embodiment of the present invention wherein the vehicle 150 includes a frame 152 having a seat assembly 154 at a rear portion thereof and a pedal assembly 156 at a front portion thereof. The pedal assembly 156 is coupled to a drive wheel assembly 158 by a chain 160 such that the drive wheel 162 rotates when the pedal assembly 156 is actuated. The drive wheel 162 is in direct contact with a top surface of the elevated rail 164 to advance the vehicle 150 along the rail 164.

In this embodiment, the coupling assembly 166 includes a front set of rollers 168 that are received within a channel 170 in a bottom section of the rail 164 to support the front section of the frame 152, suspended therefrom. The rear set of rollers 172 are also received within the channel 170 through the bottom section of the rail 164 to support the rear section of the frame 152, suspended therefrom.

It is further contemplated that as an alternative to a drive wheel assembly a turbine drive assembly may be incorporated with the various embodiments of the present invention. In such case, the pedal assembly may be coupled to a turbine for converting mechanical energy from the rotation of the pedal assembly into air flow to provide a hovering capability to the coupling assembly. The turbine drive assembly would allow the coupling assembly to float along a surface of the rail without making direct contact therewith.

Figure 5:
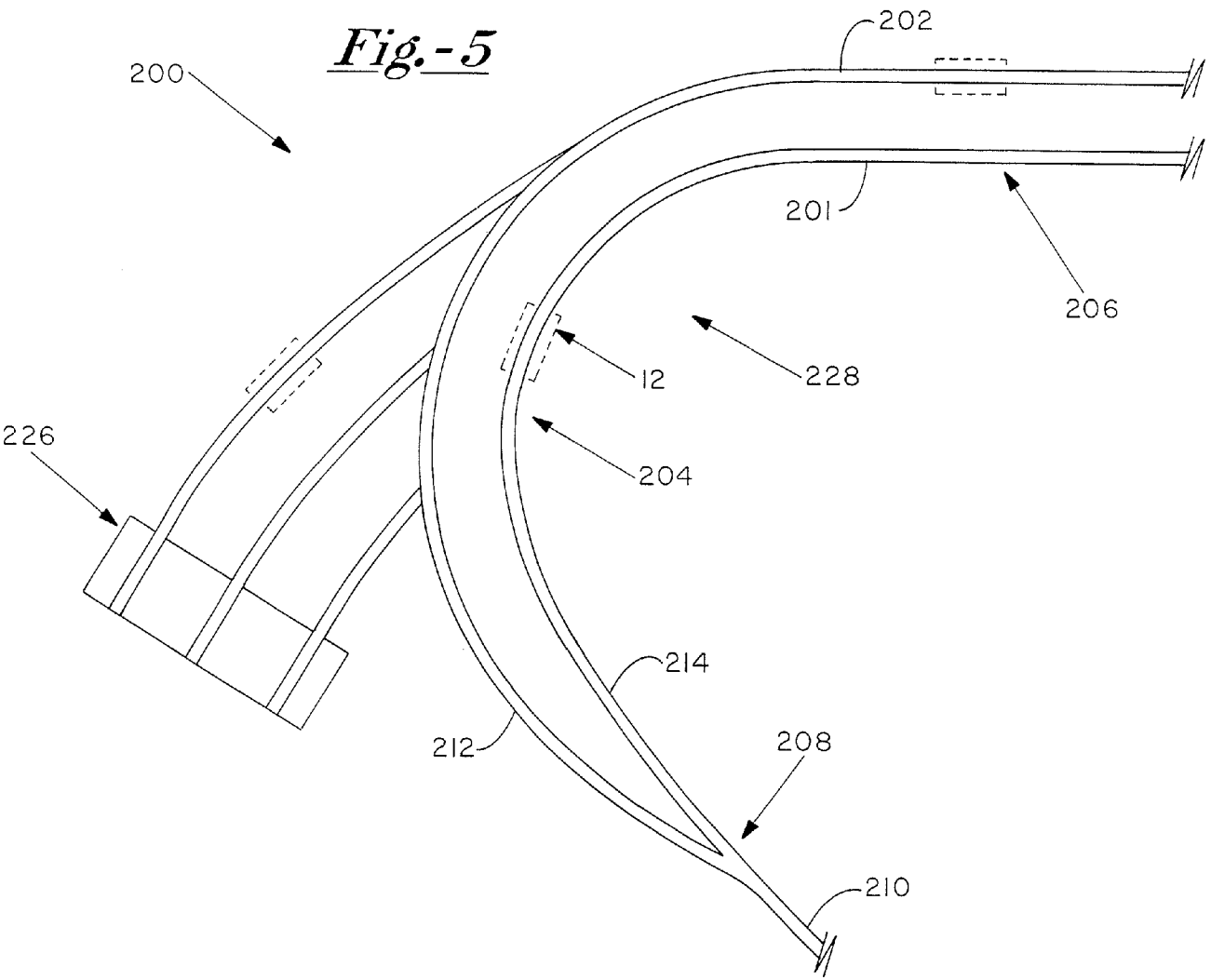
FIG. 5 illustrates a schematic depiction of a railway system of the present invention.

FIG. 5 schematically illustrates an embodiment of an elevated railway system 200 in accordance with the various embodiments of the present invention. The railway system 200 includes a plurality of distinct, but interlinked elongate pathways 201, 202 defined by distinct rails. The elongate rails 201, 202 may include one or more curved sections 204, straight sections 206 and/or combinations thereof.

The elevated railway system may be supported by a variety of support means. The railway system may be suspended from a ceiling or other such elevated support structure or the railway system may be suspended by support beams extending from a ground surface. For example, an inverted U-shaped support beam may be supported by the ground surface while allowing the carrier to advance along the rail system. Any suitable support means may be employed in accordance with the nature, location and operation of the vehicle and elevated railway system.

Figure 6:
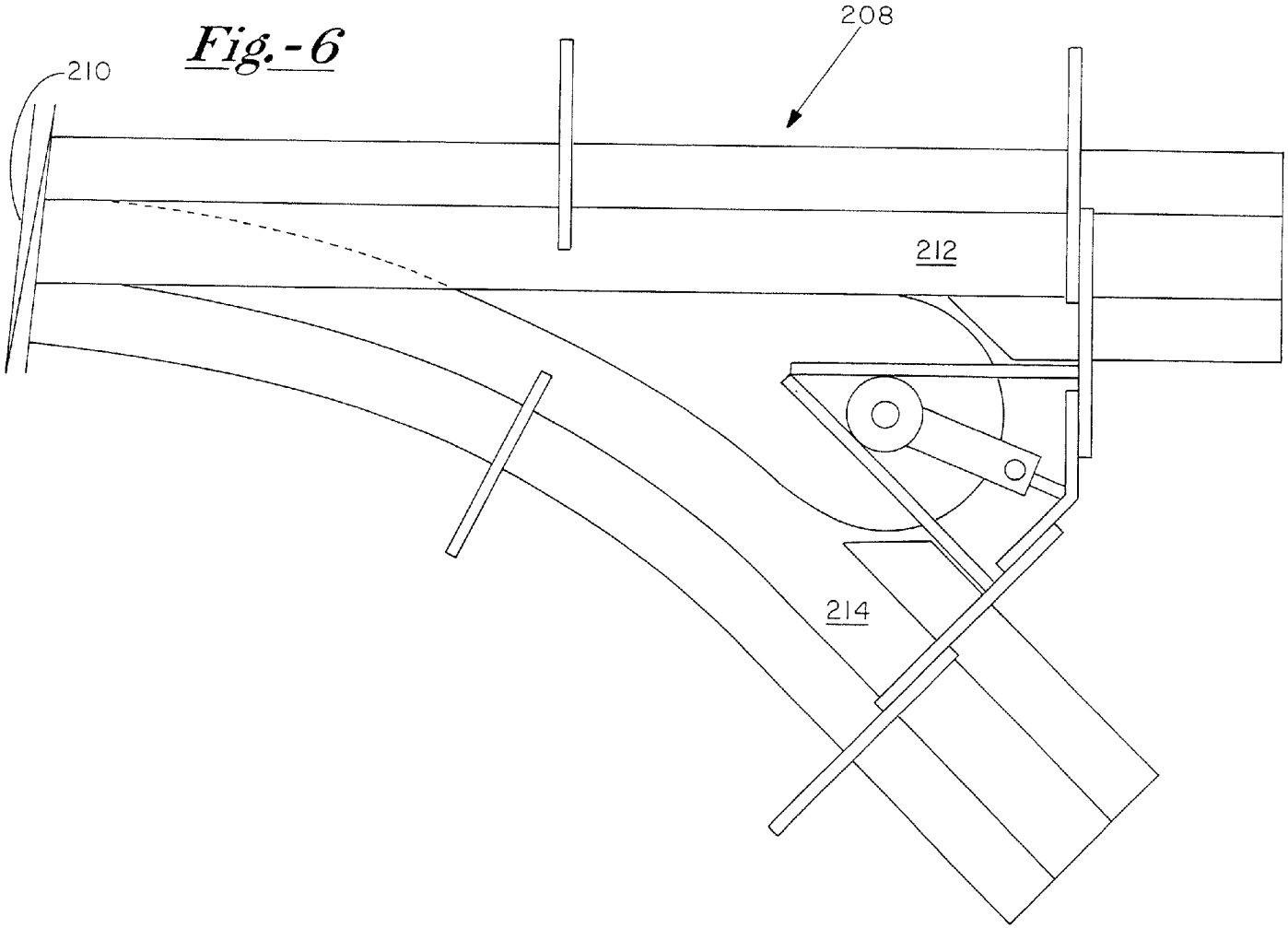
FIG. 6 illustrates a schematic depiction of an embodiment of a diverter for an elevated railway system.

FIG. 6 illustrates a diverter 208 for use in interlinking one elongate pathway with another. The diverter 208 includes a first approach channel 210 and a pair of selectable channels 212, 214 extending therefrom. The rollers 48, 49 of the coupling assembly 14 from FIGS. 2*a* and 2*b*, for example, may be received within the channel 210 and supported by opposing lips of the channel 210. The fin 62 of the coupling assembly 220 may be selectively adjusted to guide the rollers 48, 49 and coupling assembly 14 into one of the selectable channels 212, 214 in accordance with the preferences of an operator of the carrier 12.

Returning now to FIG. 5, the elevated railway system 200 may include a loading area 226 for allowing operators to enter and exit a vehicle 12 and to interchange carriers. One or more diverters 208 may be provided for allowing vehicles from the loading area 226 to enter the recreational section 228 of the elevated railway system 200. A plurality of vehicles 12 may be operated on the railway system 200 such that the vehicles 12 may selectively travel along the various interlinked rails 201, 202.

It is contemplated that sections of the railway system 200 may be abraded, such as, for example, in the loading area 226, in order to provide additional frictional engagement between the railway system 200 and the drive wheel 40 of the vehicle 12.

One embodiment of the elevated railway system 200 incorporates a plurality of substantially parallel rails, such as for defining lanes of a racing track, such as is commonly found in health club running tracks and outdoor field tracks, wherein one or more diverters are positioned along each lane of the track to allow a carrier to be selectively guided to different lanes of the track.

It is contemplated that any number of elevated rail constructions and arrangements may be utilized in accordance with the present invention including but not limited to the solid rail shown in FIG. 3, the channeled rail shown in FIG. 1 and FIGS. 2A and 2B, the T-shaped rail shown in FIG. 4 or a cable such as used on a tram or ski-lift wherein any number of suitable corresponding coupling assemblies may also be incorporated therewith.

Figure 7:
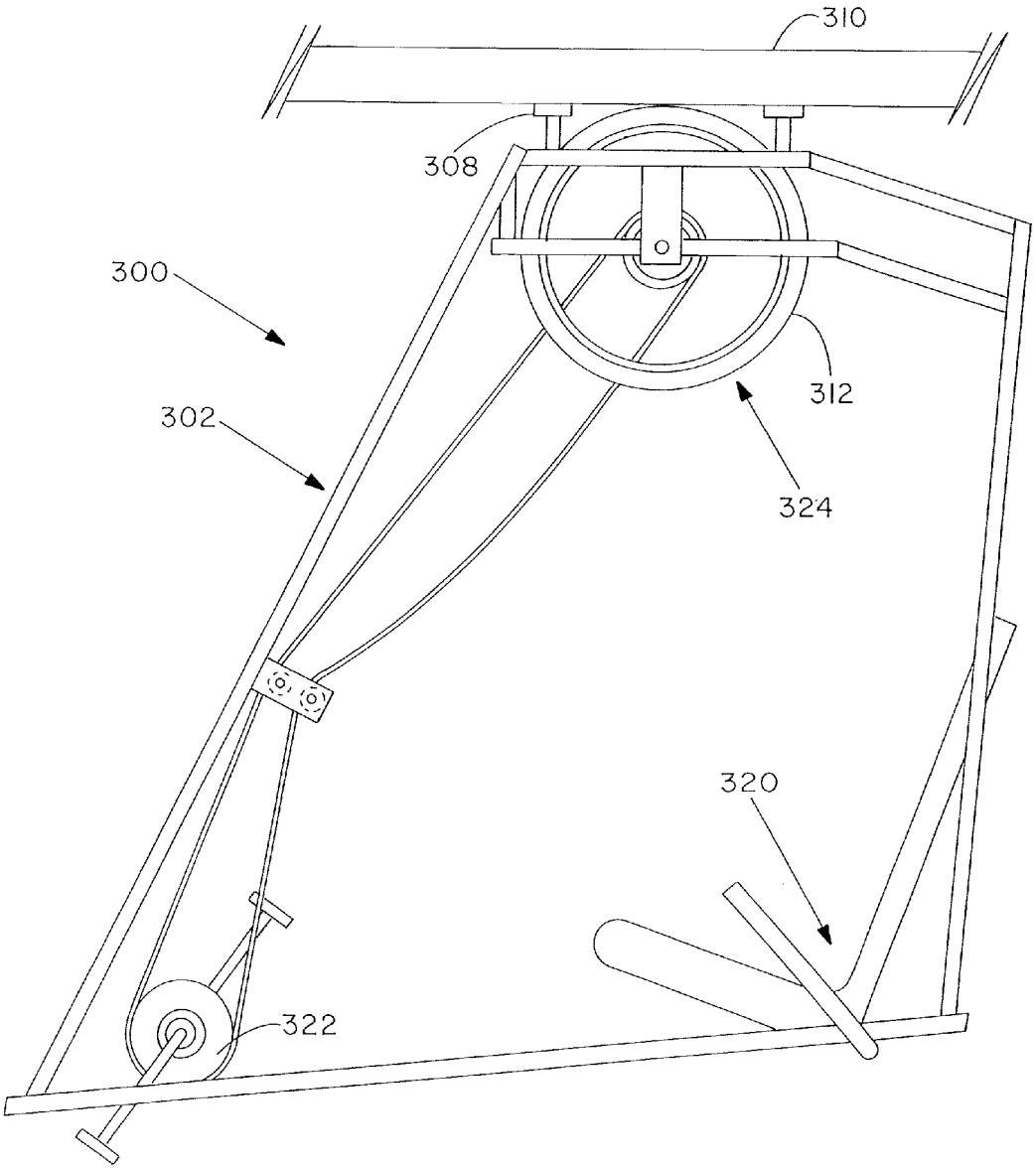
FIG. 7 illustrates an elevated railway system and vehicle suspended therefrom.
Figure 8:
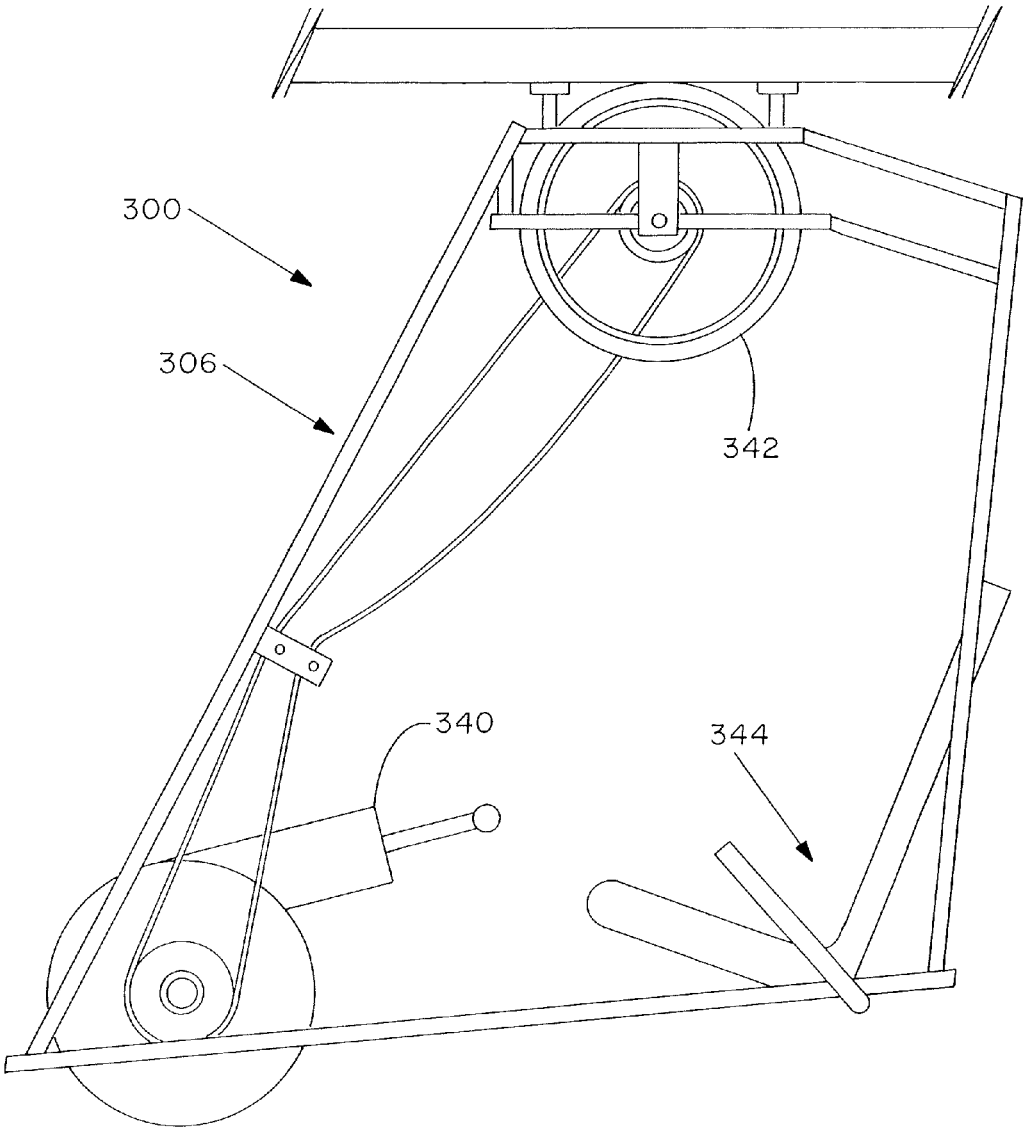
FIG. 8 illustrates a vehicle suspended from an elevated railway system.
Figure 9:
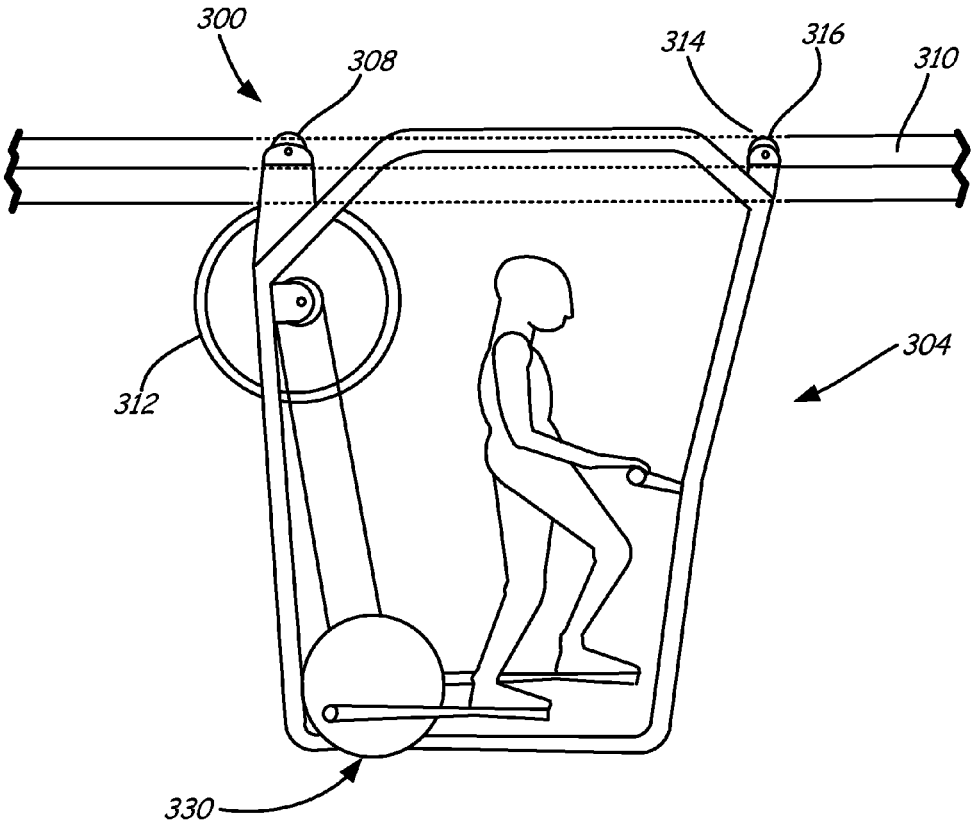
FIG. 9 illustrates a vehicle suspended from an elevated railway system.

FIGS. 7-9 show an interchangeable coupling assembly 300 for use with a plurality of vehicles 302, 304, 306. In these embodiments, the coupling assembly 300 includes one or more sets of rollers 308 configured to be movably received within a channel of the elevated rail assembly 310. The coupling assembly 300 is similar to that shown in FIGS. 2A and 2B except that the translation wheel has been eliminated. Instead, the coupling assembly 300 is selectively coupled to a vehicle 302, 304, 306 such that the drive wheel 312 of the vehicle directly contacts the bottom surface of the elevated rail 310. As shown, the vehicle 302, 304, 306 may further incorporate a second coupling assembly 314 that includes a set of rollers 316 that are received within the channel extending along the elongate dimension of the elevated rail 310.

The coupling assembly 300 is configured to allow various vehicles and vehicle configurations to be selectively and interchangeably coupled to the coupling assembly 300. The combination of the coupling assembly 300 and vehicle 302, 304, 306 shown in FIGS. 7-9 may further include the various features and functions discussed with reference to the previous embodiments, including but not limited to a brake assembly, tension members, limit rollers and the like.

FIG. 7 shows an orbiting pedal-operated vehicle 302 similar to that of previous embodiments wherein a frame is constructed to support a seat assembly 320 allowing access to a pedal assembly 322 for providing a mechanical force to the wheel assembly 324.

FIG. 8 shows a rowing machine-operated vehicle 306 having a seat assembly 344 and at least one rowing assembly 340 coupled to the drive wheel assembly 342 to provide a rotational force thereto when the rowing assembly 340 is actuated.

FIG. 9 shows a reciprocating pedal-operated vehicle 304 wherein the reciprocating pedal assembly 330 is coupled to the drive wheel 312 and the vehicle 304 is configured such that a user may selectively operate the reciprocating pedal assembly 330 for advancement of the vehicle 304 along the rail 310.

It is contemplated that any number of fitness, recreational and exercise motions, arrangements and combinations may be employed as the input device for receiving energy (e.g. kinetic energy from the operator), and translating that energy into a mechanical motion useful in motivating the vehicle along the track. In each case the motive assembly, such as a pedal assembly or rowing assembly or treadmill assembly or elliptical assembly, or other such manually driven assembly may be coupled to the drive mechanism to provide a motive force to the vehicle.

It is additionally contemplated that the vehicle may encompass any number of modifications and arrangements for ergonomics and functionality and ease of manufacture in accordance with the present invention, and such designs are not limited to those described herein.

It is also contemplated that the intended use of the present invention may be as a fitness, exercise or recreational apparatus or as a travel device including but not limited to allowing travel through minimum impact areas or constructing such elevated rails along pipelines for inspection thereof and any other suitable uses for the present invention.

Figure 10:
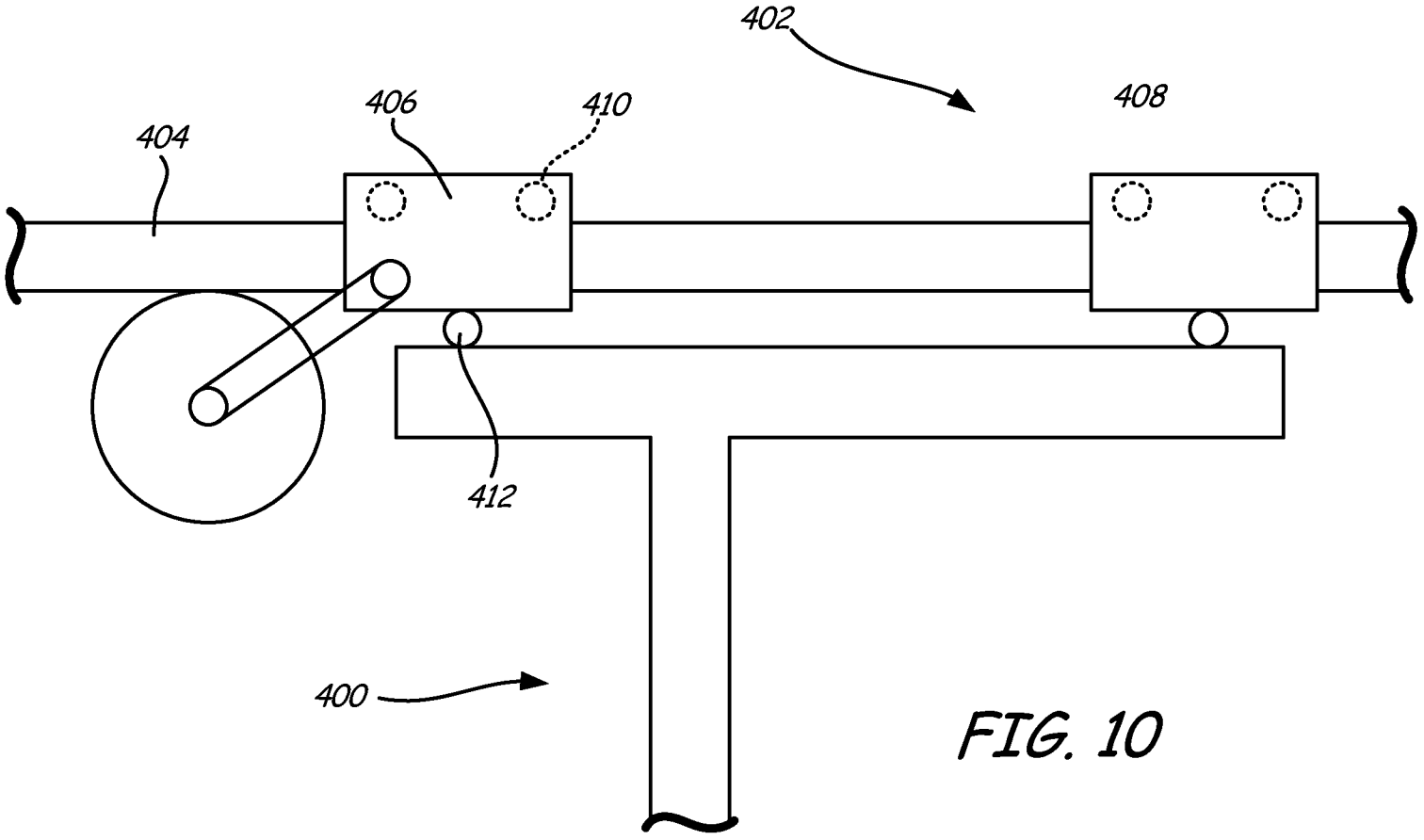
FIG. 10 illustrates a coupling assembly/drive mechanism and an elevated railway system.

FIG. 10 shows yet another embodiment of a carrier 400 and coupling assembly 402 in accordance with the present invention. In this embodiment, the coupling assembly 402 is designed to couple to a square or rounded cross-section of a rail 404. The coupling assembly 402 includes one or more sections 406, 408 each having one or more sets of load wheels 410 for engaging a top portion of the rail 404. The coupling assembly 402 includes any suitable connecting member 412 or mechanism for coupling to the carrier 400.

Figure 11:
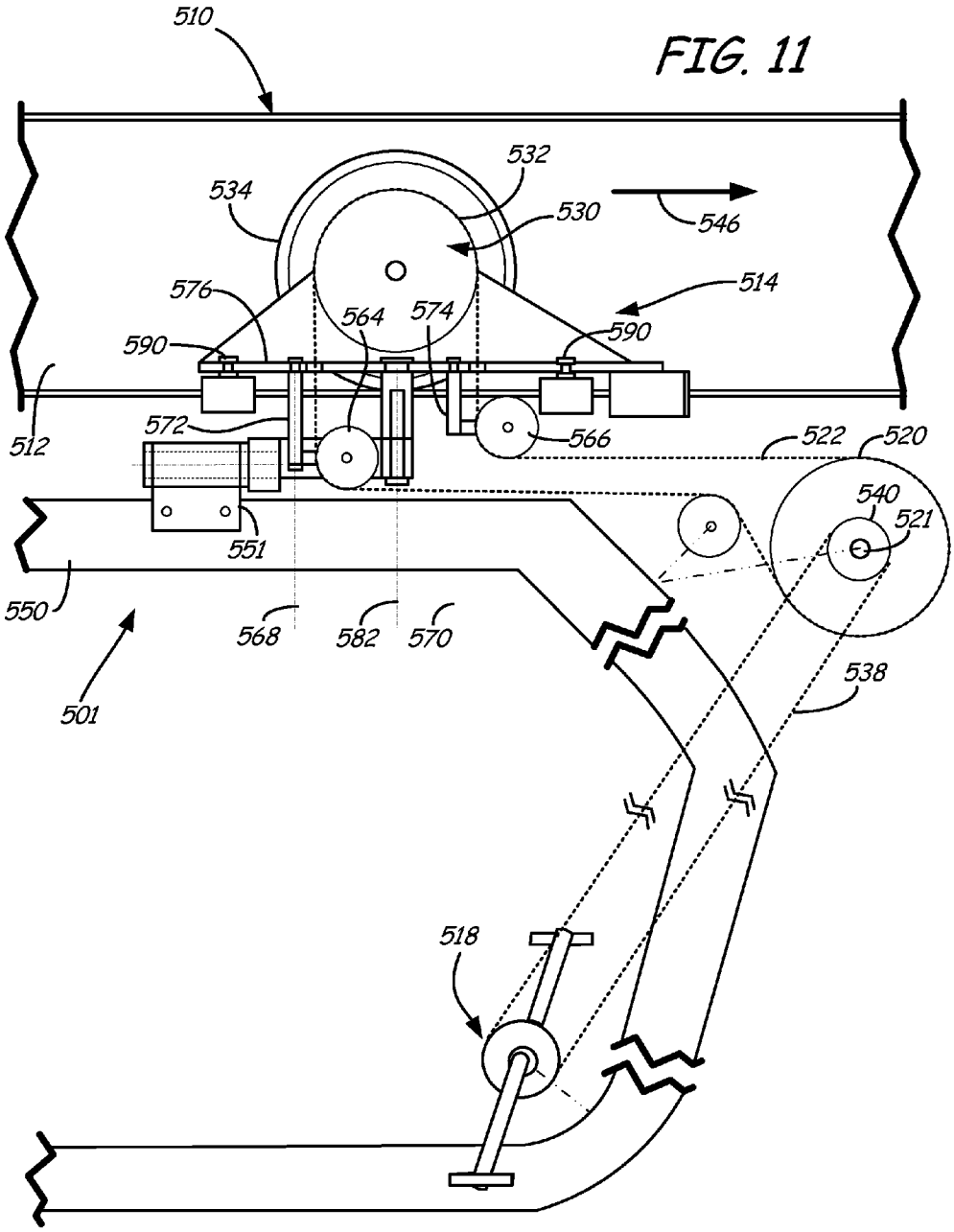
FIG. 11 illustrates a schematic depiction of a drive mechanism of the present invention.
Figure 12:
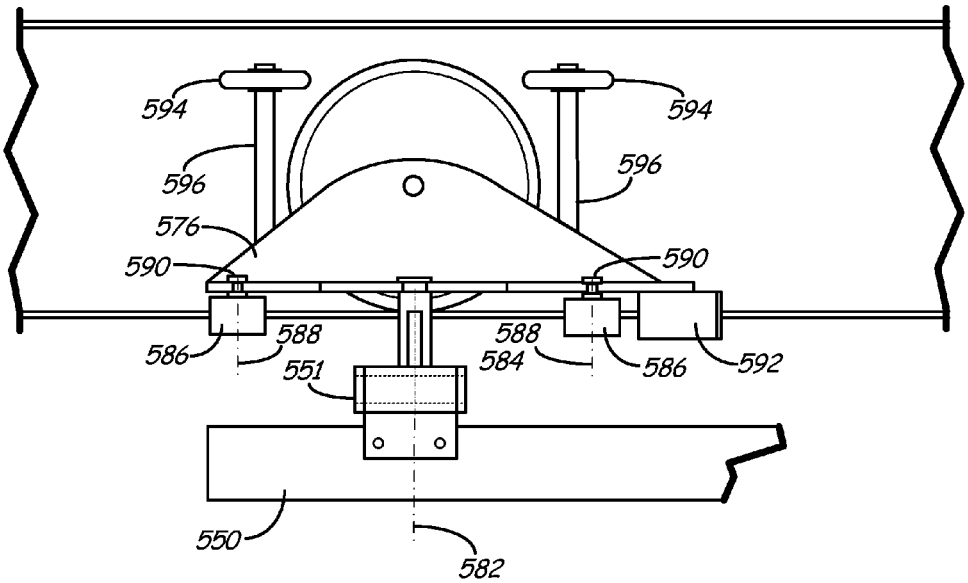
FIG. 12 illustrates a schematic depiction of a drive mechanism of the present invention.

A further embodiment of the present invention is illustrated in FIG. 11, wherein elevated railway system 510 defines a first track 512 along which a vehicle may be motivated. In the illustrated embodiment, a coupling frame 550 of the vehicle 501 is coupled to, and suspended from, drive mechanism 514, which employs an input device 518 for receiving energy and translating such energy into a mechanical motion useful in motivating vehicle 501 along first track 512. As has been described hereinabove, input device 518 may embody one or more of a variety of devices such as orbiting pedals, reciprocating pedals, rowing apparatus, and the like for actuation/manipulation by an operator of vehicle 501, with such actuation/manipulation inputting energy to input device 518, whereby the input energy may be translated into a mechanical motion, such as the motion of chain 538 that is useful in motivating vehicle 501 along first track 512. As further stated hereinabove, input device 518 may further or instead include a drive shaft emanating from a motor, such as an electrical, electromagnetic, or internal combustion motor. The generated mechanical motion may be delivered to a drive sprocket 540 of drive mechanism 514.

A first drive wheel 520 is driven by drive sprocket 540. In some embodiments, drive sprocket 540 may be fixedly secured to a first drive wheel axle 521, integrally formed, or fixedly secured to first drive wheel 520. In this manner, drive sprocket 540 and first drive wheel 520 rotate in unison about an axis 521*a* defined by axle 521, with drive sprocket 540 driven by, for example, a chain or belt 538. First drive wheel 520 supports a drive element 522, such as a drive chain or drive belt, for transmitting the mechanical motion to drive element 522 along a first radial plane "A" of first drive wheel 520. The support of drive element 522 by first drive wheel 520 may be at, for example, a toothed or recessed portion 524 of first drive wheel 520. Portion 524 may be configured in any suitable manner to support and transmit mechanical motion from first drive wheel 520 to drive element 522. Therefore, in an embodiment of drive element 522 as a chain, portion 524 may be toothed in first radial plane "A" to support and drive the drive element 522. In other embodiments, drive element 522 may comprise a belt, which may be best supported and driven by a recessed or otherwise configured portion 524 of first drive wheel 520.

Drive mechanism 514 further includes a second drive wheel apparatus 530 having a circumferential drive surface 534 in contact with first track 512. Second drive wheel apparatus 530 may include first and second rollers 548, 549 configured to be received in channel 552 of railway system 510, such that vehicle 501 is suspended therefrom. First wheel 548 may be movably engaged upon first lip 556 of first track 512, and second wheel 549 may be movably engaged upon second lip 558 of first track 512. Second drive wheel apparatus 530 may further include a drive member 532 that is adapted to receive and be driven by drive element 522. In the illustrated embodiment, drive member 532 includes a circumferential surface 533 at which drive element 522 operably engages with drive member 532 to rotate drive member 532 about drive axis 538. Drive member 532 may preferably be secured to, or integrally formed with a drive axle 539 defining drive axis 536. Wheels 548, 549 may also be secured to or integrally formed with drive axle 539 to be rotatably driven about drive axis 536 as a consequence of drive member 532 being driven by drive element 522. In some embodiments, wheels 548, 549 rotate about drive axis 536 in unison with drive member 532 and drive axle 539. Such rotational motion imparted to wheels 548, 549 conveys motion to vehicle 501 along first track 512, with wheels 548, 549 being driven along first and second lips 556, 558 of first track 512.

Figure 13:
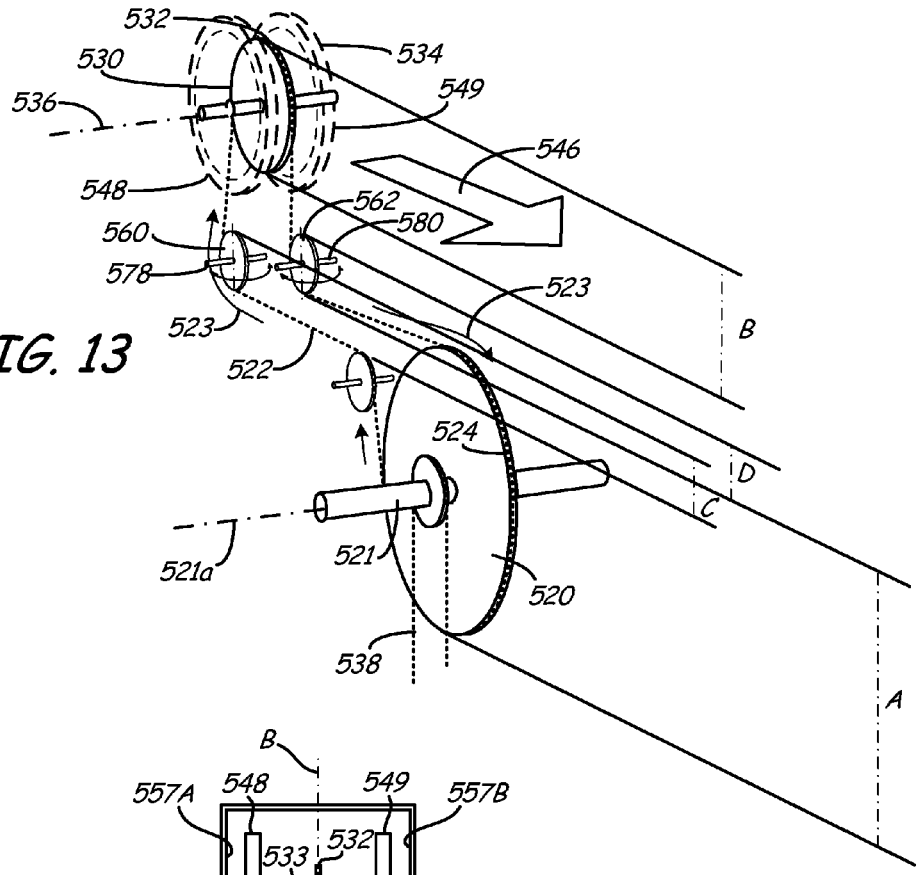
FIG. 13 illustrates a schematic depiction of a portion of a drive mechanism of the present invention.

Drive member 532 of second drive wheel apparatus 530 defines a second radial plane "B". Thus, drive element 522 engages with a portion of outer circumferential surface 533 of drive member 532 within second radial plane B. The operational driving path of drive element 522 is illustrated in FIG. 13 by arrows 523 to impart a linear motion to vehicle 501 along first track 512 in a direction illustrated by arrow 546. In one preferred embodiment of the present invention, drive axis 536 is substantially parallel to first axis of rotation 521*a*.

As contemplated herein, vehicle 501 may be driven along first track 512 of railway system 510, in which first track 512 may include combinations of straight sections and curved sections. An example railway system is illustrated in FIG. 5 with curved sections 204 and straight sections 206. To effectively and reliably operate along curved sections of railway system 510, drive mechanism 514 preferably accommodates a skewed relationship of second radial plane "B" with respect to first radial plane "A" as vehicle 501 travels along a curved section of first track 512. As vehicle 501 travels along straight sections of first track 512, first and second radial planes A, B may be substantially coextensive, as illustrated in FIG. 13. However, second drive wheel apparatus 530 may be configured to pivot about a second wheel apparatus axis 552, such that wheels 548, 549 are driven in a direction 546 consistent with the pathway of first track 512. Consequently, second drive wheel apparatus 530 may pivot about axis 552 to skew second radial plane B with respect to first radial plane A. Without accommodation by drive mechanism 513 for such skewedness, drive element 522 may have the tendency to bind and/or break in operation. Drive mechanism 514, therefore, employs pivotable first and second alignment wheels 560, 562 to position drive element 522 for proper orientation and operation in connection with first drive wheel 520 and drive member 532, respectively. In this manner, drive element 522 effectively engages with engagement portion 524 of first drive wheel 520 and outer circumferential surface 533 of drive member 532 within their respective radial planes A, B, even when such radial planes A, B are not co-extensive.

First and second alignment wheels 560, 562 radially define first and second alignment planes "C", "D" in which drive element 522 is supported about a portion of respective circumferences 564, 566 of first and second alignment wheels 560, 562. Accordingly, first and second circumferences 564, 566 may be patterned, toothed, grooved, or the like in order to engage and orient drive element 522 along its drive pathway 523. In the event that second radial plane B is skewed with respect to first radial plane A, such as in the event that vehicle 501 is traveling along a curved section of first track 512, first and second alignment wheels 560, 562 are pivotable about respective first and second pivot axes 568, 570 to adjust respective first and second alignment planes C, D into a skewed relationship with respect to second radial plane B, so as to more closely align with first radial plane A. The pivoting mechanism of first and second alignment wheels 560, 562 therefore substantially reduce stress on drive element 522. In some embodiments, drive element 522 may be a chain or belt that is capable of twisting about its longitudinal axis so as to limit binding or other stress on drive element 522 as it travels along drive path 523 between relatively skewed first and second radial planes A, B. In the manner described above, first and second alignment wheels 560, 562 are capable of pivoting about their respective pivot axes 568, 570 between substantial co-extension with both first and second radial planes A, B to an orientation in which their respective first and second alignment planes C, D are skewed with respect to at least second radial plane B. In some embodiments, one or both of first and second alignment planes C, D may be sufficiently pivotable to maintain co-extensive alignment with first radial plane A as first radial plane A skews from second radial plane B.

As illustrated in FIG. 11, first and second pivot axes 568, 570 may be substantially parallel to one another, and are defined by respective first and second pivot pins 572, 574 that are secured to a drive bracket 576 supported in channel 552 of first track 512 from drive axle 539. First and second alignment wheels 560, 562 preferably rotate about respective alignment wheel axes 578, 580 to accommodate and engage drive element 522 along its drive pathway 523. In one embodiment, first and second alignment wheels 560, 562 are positioned to re-direct drive element 522 90° to support drive element 522 in an orientation in which it engages drive member 532 at least about 180° thereof. Such positioning ensures consistent engagement between drive element 522 and drive member 532, which is particularly important in a belt embodiment of drive element 522. Contact of less than 180° about drive member 532 could result in slippage of drive element 522, and consequently inefficient propulsion of vehicle 501.

Figure 14:
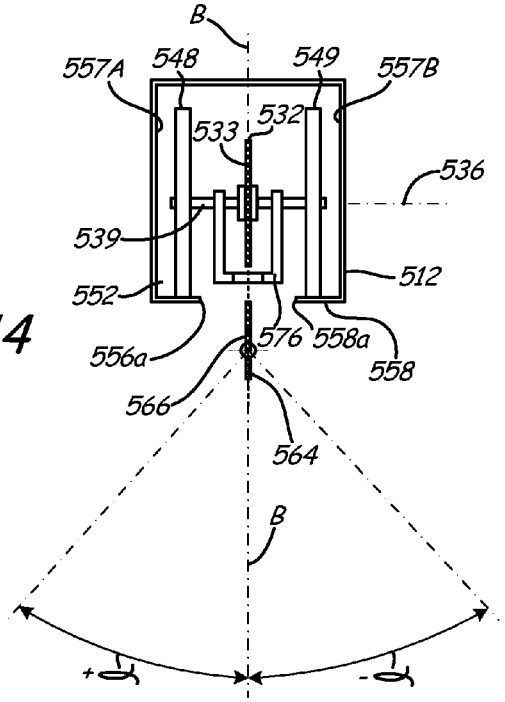
FIG. 14 illustrates a schematic depiction of a portion of a drive mechanism of the present invention.

The pivoting capability of first and second alignment wheels 560, 562 is illustrated in FIG. 14. It is contemplated that both of first and second alignment wheels 560, 562 are capable of pivoting with respect to second radial plane B by at least an angle "α" of +/−10°, and more preferably at least +/−30°.

Second drive wheel apparatus 530 may suspend vehicle 501 at coupling frame 550 through a coupling bracket 551. As described above, coupling frame 550 and coupling bracket 551 are pivotally secured to drive bracket 576, and correspondingly second drive wheel apparatus 530, about second drive wheel apparatus axis 582, which may be defined by main pivot pin 584. In some embodiments, main pivot pin 584 is pivotally secured to drive bracket 576, so as to be capable of rotating with respect to drive bracket 576 about second drive wheel apparatus axis 582. Second drive wheel apparatus axis 582 may pass through drive axle 539 to most efficiently permit pivoting of second drive wheel apparatus 530 with respect to vehicle 501. Such pivoting is particularly important as second drive wheel apparatus 530 follows first track 512 around a curved section. It is contemplated that vehicle 501 may include suspension mechanisms at a plurality of distinct positions, such as that illustrated in the embodiments of FIGS. 9 and 10. In such case, vehicle 501 is preferably pivtoable with respect to the drive and supporting apparatus within railway system 501, due to the fact that spaced-apart drive and suspension mechanisms about a curved first track 512 possess radial planes that are skewed with respect to one another. To accommodate such skewed relationship, it is preferably that vehicle 501 be pivotally secured, as opposed to fixedly secured, to the respective drive/suspension elements within railway system 510.

As in previous embodiments, drive mechanism 514 may include one or more guide rollers 586 that rotate about respective guide roller axes 588. Guide rollers 586 may be rotatably secured to drive bracket 576 through roller pins 590. Guide rollers 586 may be positioned with respect to drive bracket 576 between first and second lips 556, 558 of first track 512. In particular, guide rollers 586 may act as "stops" to limit or prevent movement of second drive wheel apparatus 530 toward either of side walls 557A, 557B of first track 512.

Therefore, guide rollers 586 may be in constant or intermittent contact with one or both of lip edges 556A, 558A to maintain a relative position of second drive wheel apparatus 530 within channel 552. An additional centering guide 592 may be secured to drive bracket 576 to further support and orient second drive wheel apparatus 530 within channel 552.

In some embodiments, centering rollers 594 may be employed instead of, or in addition to, guide rollers 586 to maintain a desired relative position of second drive wheel apparatus 530 within channel 552 of first track 512. Centering rollers 594 may be rotatably secured to rods 596, which are themselves secured to drive bracket 576. Centering rollers 594 may be positioned and oriented to continuously or discontinuously contact one or both of first and second inner walls 557A, 557B of first track 512. In this manner, wheels 548, 549 maintain a desired path of apparatus 530 along first track 512 out of contact with side walls 557A, 557B.

Figure 19:
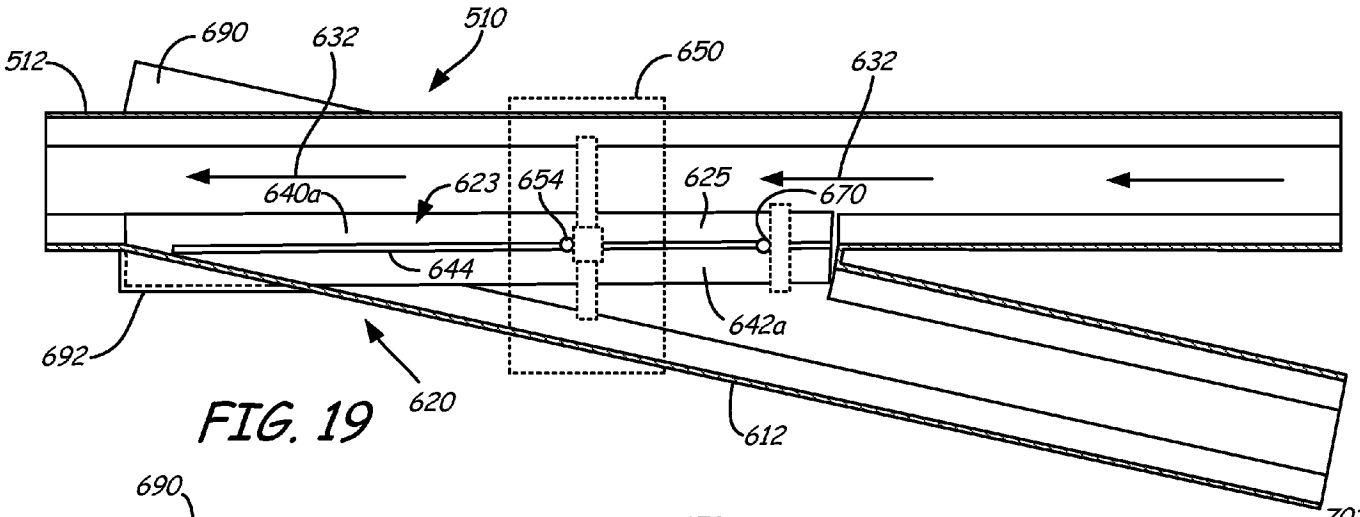
FIG. 19 is an isolation top plan view of a portion of an elevated railway system of the present invention in an open condition.
Figure 20:
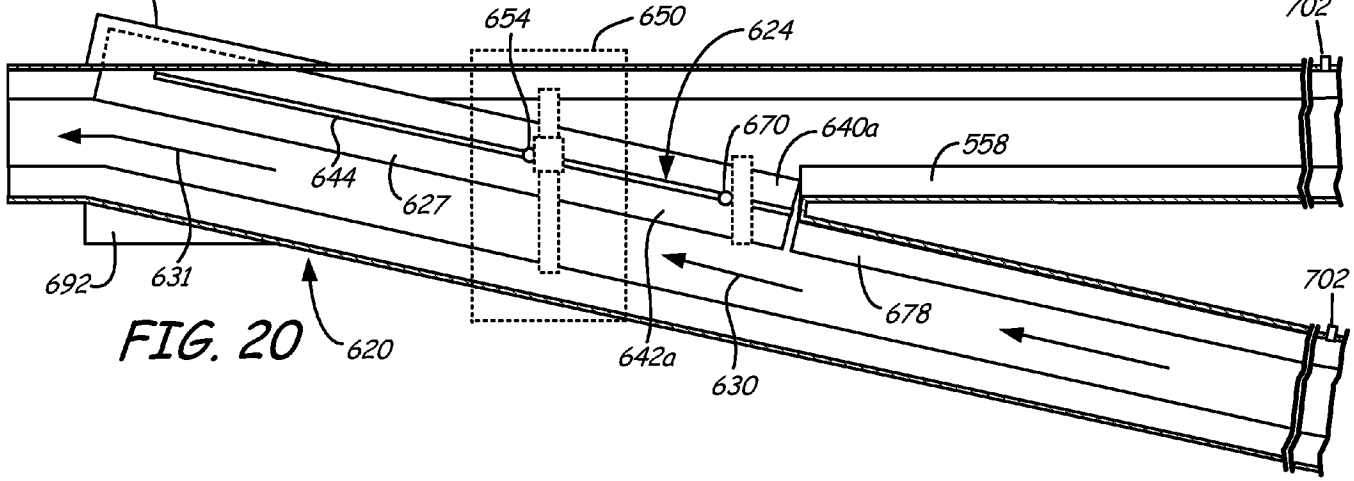
FIG. 20 is an isolation top plan view of a portion of an elevated railway system of the present invention in a closed condition.
Figure 21:
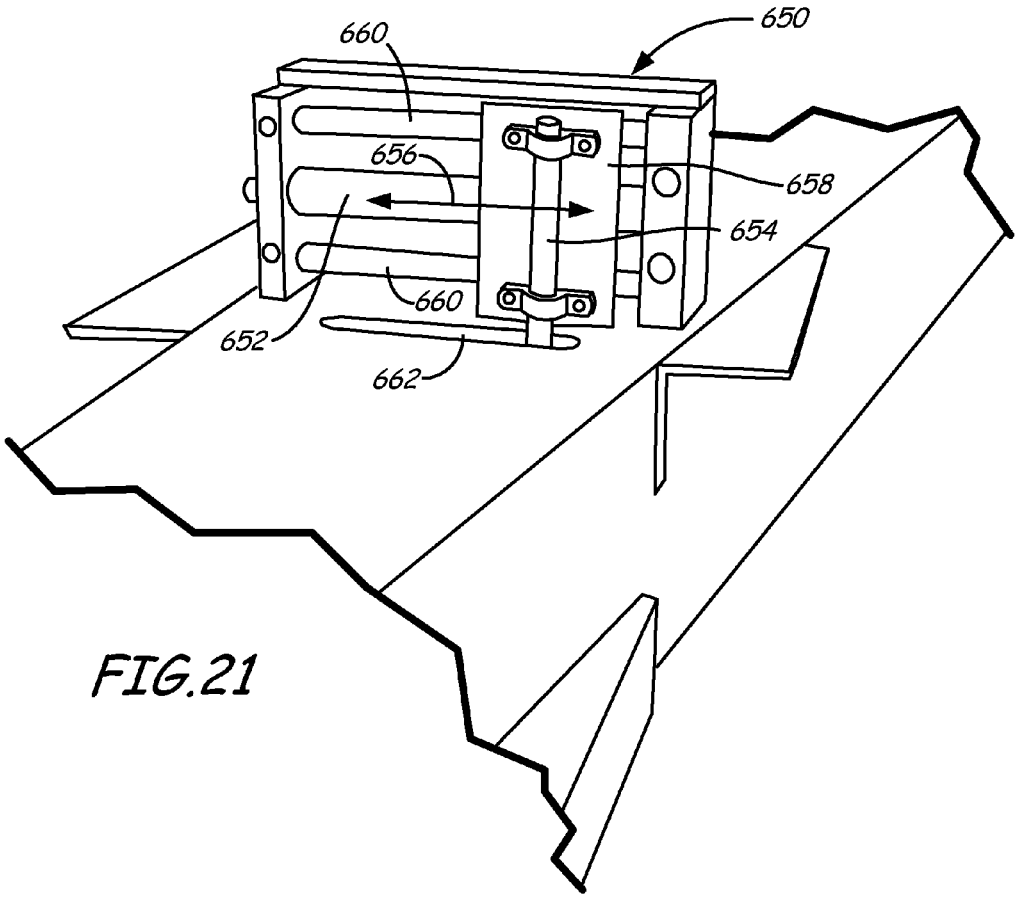
FIG. 21 illustrates a portion of an elevated railway system of the present invention.
Figure 22:
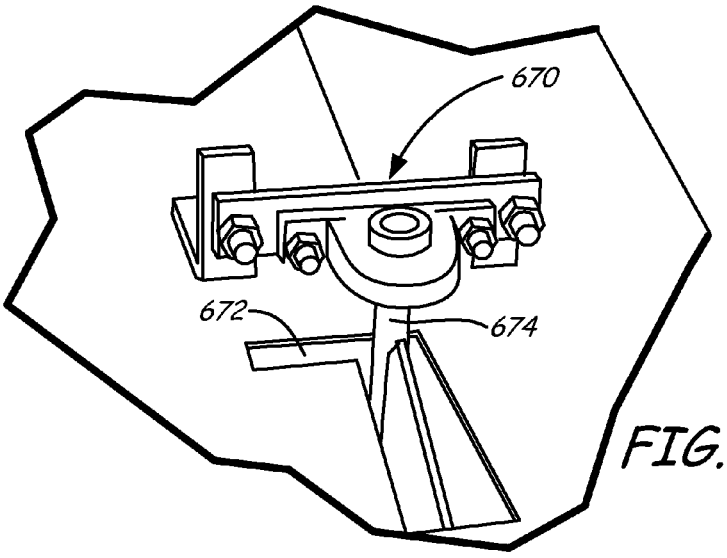
FIG. 22 illustrates a portion of an elevated railway system of the present invention.
Figure 23:
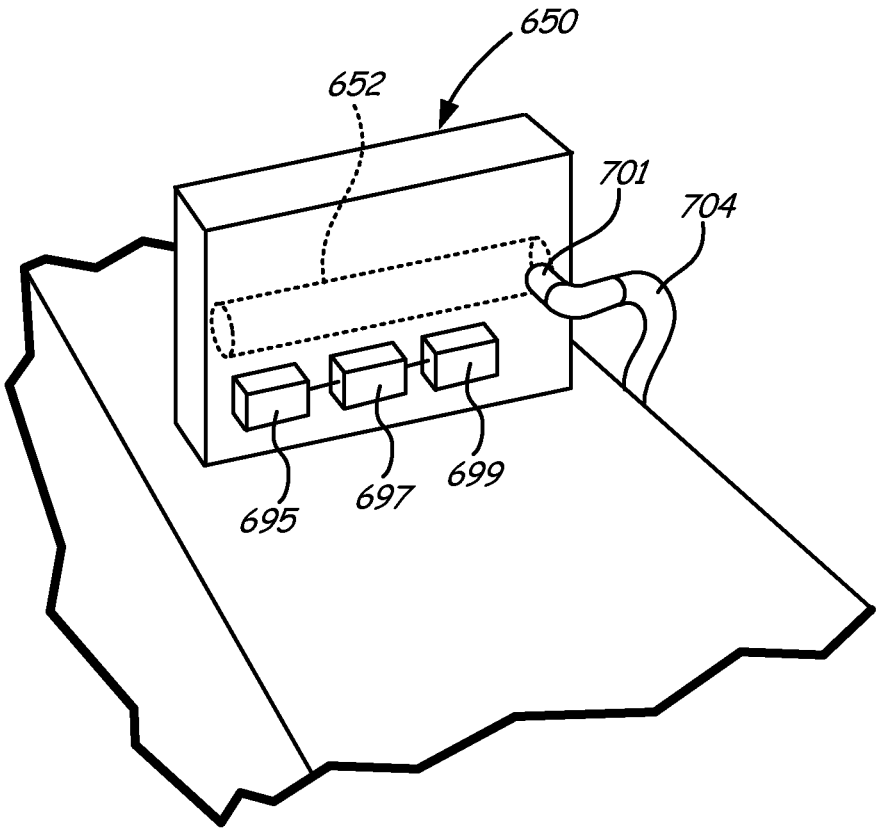
FIG. 23 illustrates a schematic depiction of a portion of an elevated railway system of the present invention.

Elevated railway system 510 may include a plurality of tracks, such as first track 512 and second track 612. A first carrier rail 511 includes a first interior chamber 552 defining first track 512. Elevated railway system 510 may include a second carrier rail 611 having a second interior channel 652 defining a second track 612. Elevated railway system 510 includes a merging portion 620 and a diverging portion 622 connecting first carrier rail 511 to second carrier rail 611. Diverging portion 622 of railway system 510 is illustrated in FIGS. 15-18. Merging portion 620 of railway system 510 is illustrated in FIGS. 19-20.

Merging portion 620 of railway system 510 includes a first door 623 that is selectively actuatable between an open position 625 (FIG. 19) and a closed position 627 (FIG. 20) for selectively and reversibly establishing a merging condition of second track 612 to first track 512. The merging condition is selectively and reversibly established when first door 623 is in closed position 627, such that vehicle 501 is merged from second track 612 onto first track 512 along merging pathway 631. A non-merging condition for allowing vehicle 501 to maintain an unobstructed path along non-diverting pathway 632 along first track 512 is restored when first door 623 is returned to open position 625.

Diverging portion 622 of railway system 510 includes a second door 624 that is selectively actuatable between an open position 626 (FIGS. 15 and 17) and a closed position 628 (FIGS. 16 and 18) for selectively and reversibly establishing a diverging condition of second track 612 from first track 512. The diverging condition is selectively and reversibly established when second door 624 is in closed position 628, such that vehicle 501 is diverted from first track 512 to second track 612 along diverting pathway 630 into and along second track 612. A non-diverging condition is restored when second door 624 is returned to open position 626, such that vehicle 501 remains along non-diverting pathway 632 along first track 512.

Each of first and second doors 623, 624 include a first track portion 640*a*, 640*b*, and a second track portion 642*a*, 642*b*. First track portions 640*a*, 640*b* of first and second doors 623, 624 selectively complete first track 512 at merging portion 620 and diverging portion 622, respectively. Thus, first track portions 640*a*, 640*b* form a portion of first track 512, and may be selectively positioned to complete first track 512 at the respective merging portion 620 and diverging portion 622 when first and second doors 623, 624 are actuated into an open position 625, 626. By "completing" first track 512, it is meant that first track portions 640*a*, 640*b* support, for example, at least a portion of second drive wheel apparatus 530 as it passes through a respective merging portion 620 or diverging portion 622 along non-diverting pathways 632 of first track 512. Second track portions 642*a*, 642*b* of first and second doors 623, 624 selectively complete second track 612 at respective merging and diverging portions 620, 622. Therefore, second track portions 642*a*, 642*b* support vehicle 501 by supporting at least a portion of second wheel apparatus 530 as it passes through merging portion 620 or diverging portion 622 along diverting pathway 630 onto, or off from, second track 512. In some embodiments, first and second track portions 640*a*, 640*b*, 642*a*, 642*b* of first and second doors 623, 624 are in the form of flanges or lips substantially consistent in dimension and configuration with first and second lips 556, 558 of first track 512 described hereinabove. Therefore, first and second doors 623, 624 provide movable sections of lips/flanges to support, for example, a respective wheel 548, 549 of apparatus 530 as apparatus 530 passes through merging or diverging portions 620, 622.

An actuation mechanism 650 may be provided for pivoting a respective first or second door 623, 624 between respective open and closed positions. For example, actuation mechanism 650A may be provided for pivoting first door 623 between respective open and closed positions 625, 627. Likewise, a second actuation mechanism 650B may be provided for pivoting second door 624 between respective open and closed positions 626, 628. For simplicity in the description of actuation mechanism 650, only a single actuation mechanism 650 is illustrated and described. However, it is to be understood that similar or identical actuation mechanisms 650A, 650B may be employed with respect to first and second doors 623, 624. However, it is also contemplated that different actuation mechanisms may be employed for the actuation of first and second doors 623, 624 between respective open and closed positions.

Figure 15:
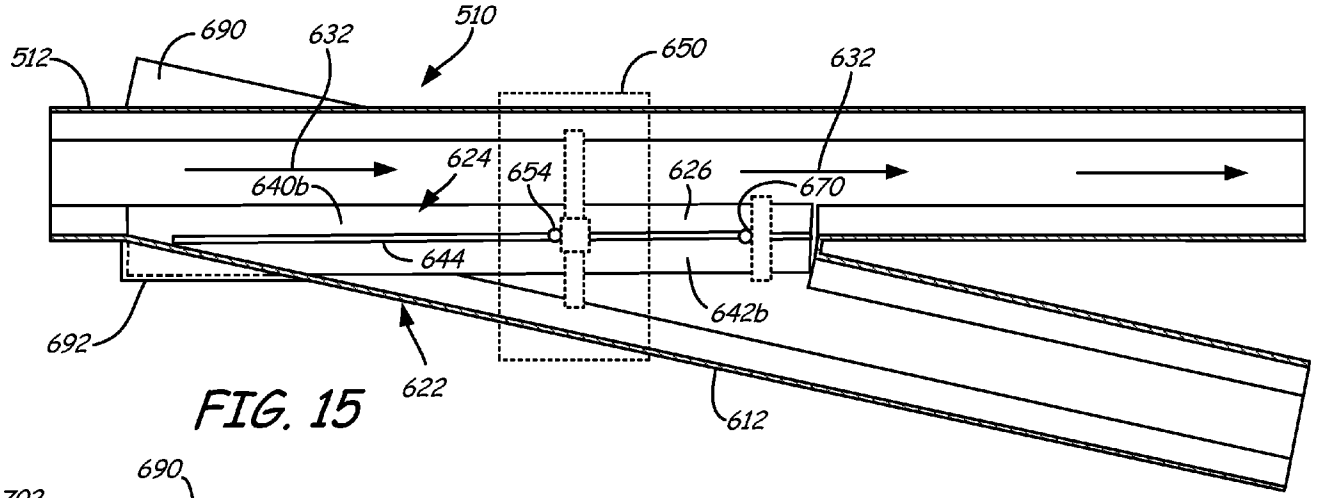
FIG. 15 is an isolation top plan view of a portion of an elevated railway system of the present invention in an "open" condition.
Figure 16:
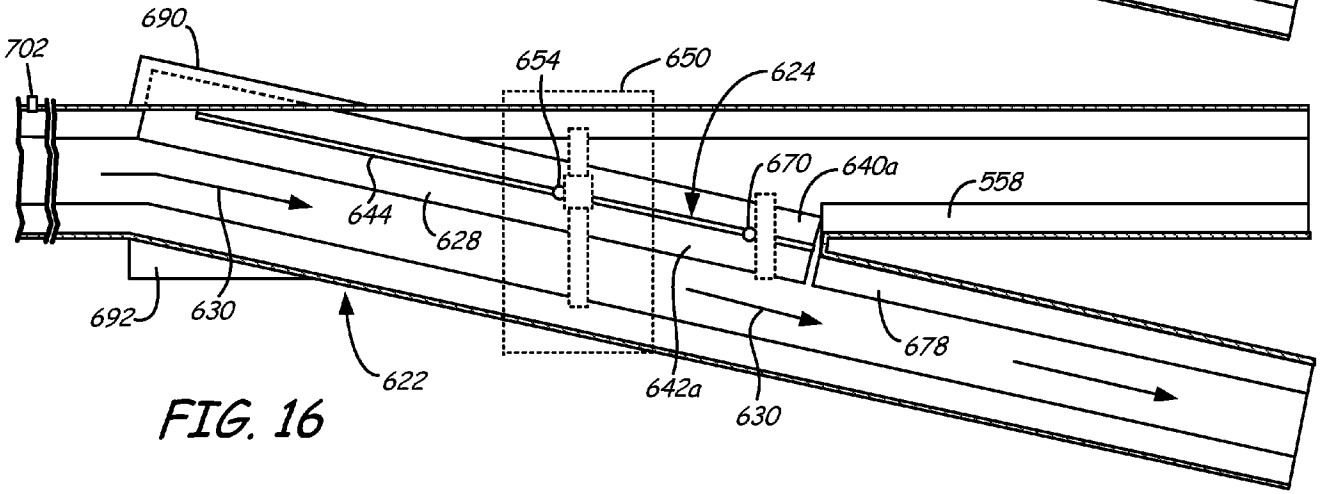
FIG. 16 is an isolation top plan view of a portion of an elevated railway system of the present invention in a "closed" condition.
Figure 17:
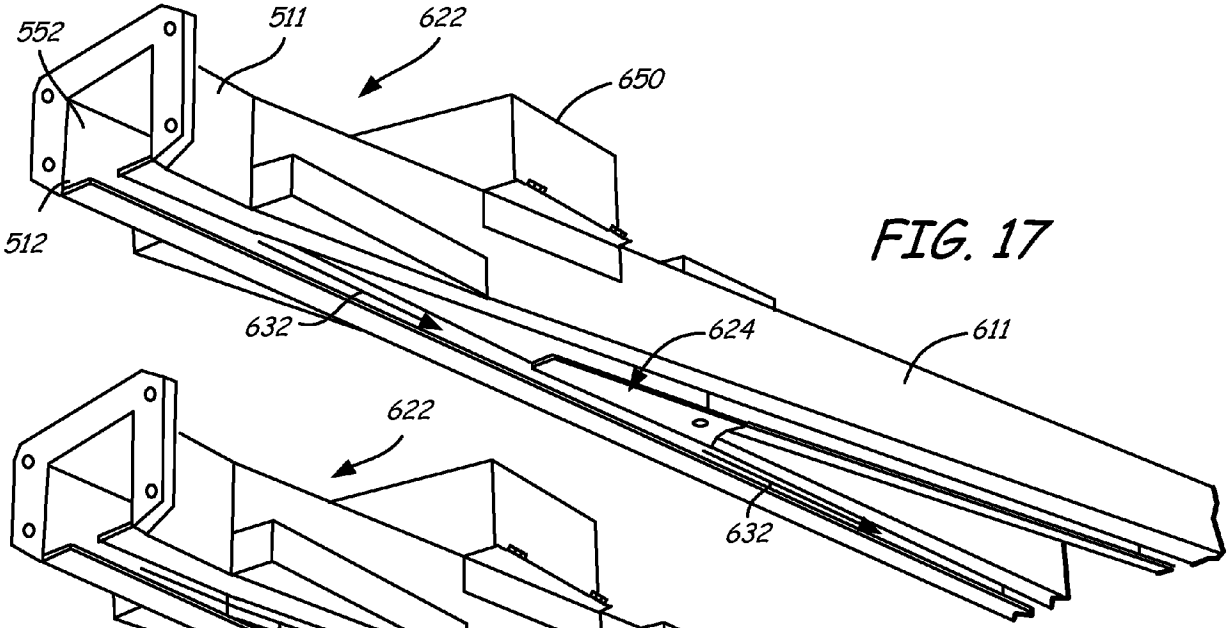
FIG. 17 is an isolation bottom plan view of a portion of an elevated railway system of the present invention in an "open" condition.
Figure 18:
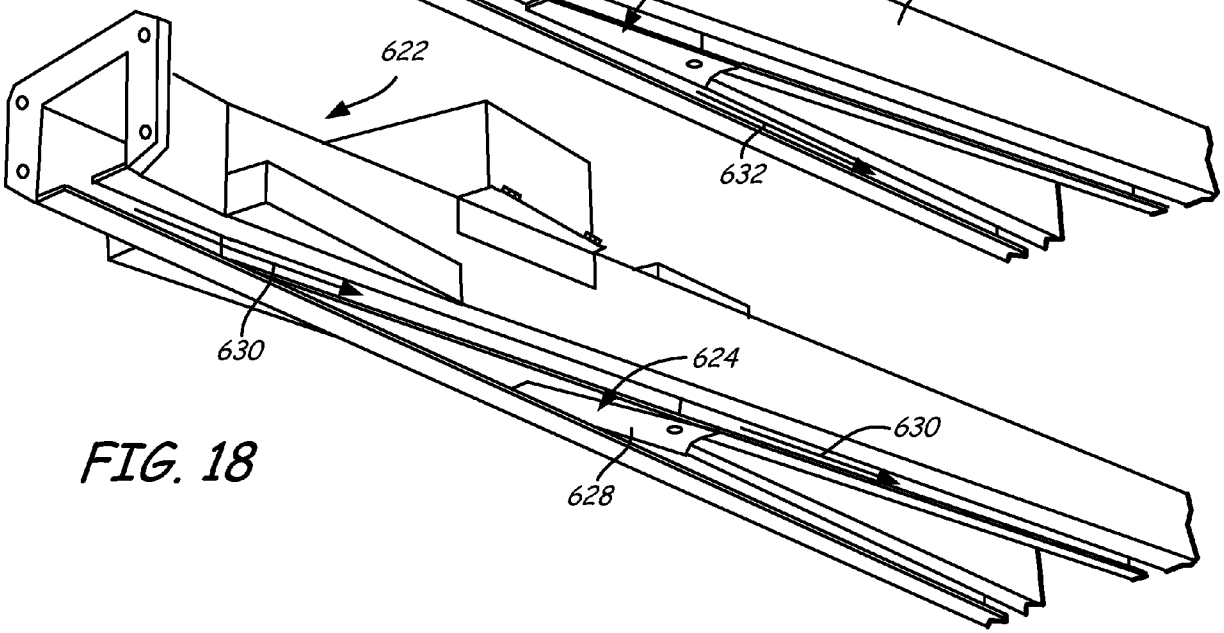
FIG. 18 is an isolation top plan view of a portion of an elevated railway system of the present invention in a "closed" condition.

In the illustrated embodiment, actuation mechanism 650 includes a pneumatically-driven piston 652 that drives control rod 654 reciprocally along direction 656. Control rod 654 is secured to pneumatically-driven piston 652 at connection plate 658, which is guided by guide bars 660 to move control rod 654 along directions 656. Control rod 654 is secured to a respective first or second door 623, 624 through slot 662. The selective reciprocal motion of control rods 654, actuated by the selected actuation of piston 652, moves respective first or second door 623, 624 between open and closed positions. Such an operation is illustrated in FIGS. 15 and 16.

To accommodate the selective shift of first or second door 623, 624 between open and closed positions, a pivot 670 may be employed. Pivot 670 acts as a sliding pivot location for an end portion of first or second door 623, 624 to substantially precisely align along one of lips 558 or 678 of respective first and second tracks 512, 612 in the shifting between open and closed positions. Pivot 670, therefore, includes a slot 670 in which a pivot control bar 674 may operate during the pivoting movement of first or second door 623, 624.

To accommodate the shifting of first or second door 623, 624 between open and closed positions, first and second carrier rail chambers 690, 692 are provided to house a respective first or second track portion 640A, 640B, 642A, 642B out of the way of the merging or diverging track portion of first or second door 623, 624. To aid in routing vehicle 501 along diverting pathway 630 or non-diverting pathway 632, a divider 644 may be included for separating first track portions 640A, 640B from respective second track portions 642A, 642B. Divider 644 may be a flange or other mechanical device oriented substantially perpendicularly to first and second track portions 640, 642 of first and second doors 623, 624. Such divider 644 can act as an outer boundary to assist in directing second drive wheel apparatus 530 along a desired pathway.

In some embodiments, actuation mechanism 650 may be responsive to an electromagnetic signal. Actuation mechanism 650 may therefore include a receiver 695, a signal processor 697, and a controller 699 for controlling an inlet valve 701 of pressurized gas 704, such as air, to pneumatic piston 652. In some embodiments, the inlet valve 701 is a solenoid valve actuated by the selective energizing of an active electromagnet, as is known in the art. The electromagnetic signal may be manually generated by a system operator, or may instead be generated by an electromagnetic signal sender responsive to a position sensor 702 sensing the presence or absence of, for example, vehicle 501. In one embodiment, a position sensor 702 may be positioned at first or second carrier rails 511, 611 in order to detect the presence of vehicle 501. As vehicle 501 passes by position sensor 702, an electrical signal is generated and received by an electromagnetic signal sender to communicate a signal through a known communication wavelength to signal receiver 695 at actuation mechanism 650. A controller 699 may interpret the received signal and determine whether to open a respective inlet valve 701 to pneumatic piston 652 to adjust a respective first or second door 623, 624 between open and closed positions. Position sensor 702 may be located at railway system 510 at a position at which vehicle 501 passes prior to reaching merging portion or diverging portion 620, 622. That way, first or second door 623, 624 may be properly positioned before vehicle 501 reaches merging portion or diverging portion 620, 622.

It is further contemplated that the vehicles in accordance with the present invention may include additional functional features including but not limited to those described above such as a hand brake, a throttle, a steering fin and the like. It is further contemplated that such vehicles may be configurable to be encapsulated such that a rider is in an enclosed environment. The encapsulated compartment may further include but is not limited to amenities such as heat and air conditioning, such as for use of the carrier in inclimate weather.

The various embodiments described herein are illustrative of the present invention and not limiting as to the scope and spirit of the present invention.

The invention has been described herein in considerable detail in order to comply with the patent statutes, and to provide those skilled in the art with the information needed to apply the novel principles and to construct and use embodiments of the invention as required. However, it is to be understood that various modifications may be accomplished without departing from the scope of the invention itself.

What is claimed is:

1. A recreational apparatus, comprising:

an elevated railway system defining a first track;

a vehicle motivatable along said first track with a drive mechanism, wherein said drive mechanism includes:

(i) an input device for receiving energy and translating said energy into a mechanical motion useful in motivating said vehicle along said first track, said mechanical motion being delivered to a drive sprocket;

(ii) a first drive wheel apparatus driven by said drive sprocket, said first drive wheel supporting a drive element, and transmitting said mechanical motion to said drive element, said input device, first drive wheel and drive element are together commonly aligned along a first radial plane of said first drive wheel apparatus;

(iii) a second drive wheel apparatus having a circumferential drive surface in contact with said first track, and having a drive member being rotatably driven about a drive axis by said drive element to convey motion to said vehicle along said first track, said drive member of said second drive wheel apparatus defining a second discreet radial plane;

(iv) a first alignment wheel defining a first alignment plane in which said drive element is supported, and wherein said first alignment wheel is pivotable about a first pivot axis to adjust said first alignment plane between substantial co-extension with both said first and second radial planes, and skewed with respect to said second radial plane; and (v) a second alignment wheel defining a second alignment plane in which said drive element is supported, and wherein said second alignment wheel is pivotable about a second pivot axis to adjust said second alignment plane between substantial coextension with both said first and second radial planes, and skewed with respect to said second radial plane.

2. A recreational apparatus as in claim 1 wherein said first and second pivot axes are substantially parallel to one another.

3. A recreational apparatus as in claim 1 wherein said input device is an input wheel driven by manual force exerted by a user.

4. A recreational apparatus as in claim 1 wherein said drive sprocket and said first drive wheel share a first axis of rotation.

5. A recreational apparatus as in claim 4 wherein said first axis of rotation is parallel to said drive axis.

6. A recreational apparatus as in claim 1 wherein said drive element is a chain or belt.

7. A recreational apparatus, comprising:

a vehicle adapted for suspension along an elevated railway, said vehicle having a drive mechanism;

a drive input of said drive mechanism, said drive input having a drive sprocket, said drive input adaptable to receive energy and translate said energy into a mechanical motion of said drive sprocket;

a first drive wheel apparatus having a drive element coupled to drive sprocket, said drive sprocket and said drive element aligned along a first radial plane, wherein mechanical motion of said drive sprocket corresponds with mechanical motion of said drive element;

a second drive wheel apparatus having at least one wheel adapted to circumferentially contact a first track of the railway, said second drive wheel apparatus further having a drive member adapted to be rotated about a drive axis by the mechanical motion of said drive element to convey motion to said vehicle along said first track, said drive member of said second drive wheel apparatus and a portion of said first drive wheel apparatus defining a second radial plane; and first and second opposed guide wheels aligned in an opposing position and adapted to contact opposing sides of the first track of the railway, said first and second guide wheels include corresponding alignment wheels having a respective first and second pivot axis to adjust an alignment plane between both said first and second radial planes.

8. A recreational apparatus as in claim 7 wherein said first and second pivot axis are substantially parallel to one another.

9. A recreational apparatus as in claim 7 wherein said drive input includes an input wheel driven by manual force exerted by a user.

10. A recreational apparatus as in claim 7 wherein said drive sprocket and said drive input share a first axis of rotation.

11. A recreational apparatus as in claim 10 wherein said first axis of rotation is aligned parallel to said drive axis of said second drive wheel apparatus.

12. A recreational apparatus as in claim 1 wherein said first radial plane and said second radial plane are aligned parallel but offset from each other.

13. A recreational apparatus suitable for suspension along an elevated railway, said apparatus comprising:

a vehicle adapted to be suspended on a ran;

a coupling assembly that couples said vehicle to the ran, said coupling includes a pivot member coupled to the rail so that the coupling assembly is capable of pivoting about a longitudinal axis of the rail, said coupling assembly further including opposing guide wheels that are adaptable to contact side portions of the rail to stabilize said coupling assembly; and a motivation mechanism capable of receiving an energy input and converting the energy input into a motivational motion of said vehicle, said motivation mechanism including a drive mechanism adapted to engage the rail and roll along the rail on which the vehicle is suspended.

14. The recreation apparatus as recited in claim 13, wherein at least a portion of the drive mechanism is adapted to contact an under portion of the rail.

15. The recreation apparatus as recited in claim 13, wherein at least a portion of the drive mechanism is adapted to contact an upper portion of the rail.

16. The recreation apparatus as recited in claim 13, wherein said motivation mechanism further includes a drive assembly coupled to said drive mechanism.

17. The recreation vehicle as recited in claim 16, wherein said drive assembly includes a pedal assembly.

18. The recreation vehicle as recited in claim 17, wherein said pedal assembly includes a crank system and a gear system.

19. The recreation vehicle as recited in claim 16, wherein said motivation mechanism is capable of motivating the vehicle by converting energy received from configurations selected from the group consisting of a bicycle configuration, an elliptical machine configuration, and a rowing machine configuration.

* * * * *